US007152954B2

(12) United States Patent
Katayama

(10) Patent No.: US 7,152,954 B2
(45) Date of Patent: Dec. 26, 2006

(54) SET OF INK CARTRIDGES, INK CARTRIDGE AND INK JET PRINTER

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/949,343

(22) Filed: Sep. 27, 2004

(65) Prior Publication Data

US 2005/0068369 A1 Mar. 31, 2005

(30) Foreign Application Priority Data

Sep. 30, 2003 (JP) ..... 2003-341668

(51) Int. Cl.
*B41J 2/14* (2006.01)
*B41J 2/175* (2006.01)

(52) U.S. Cl. ..... 347/49; 347/85; 347/86

(58) Field of Classification Search ..... 347/40, 347/49, 84–87

See application file for complete search history.

(56) References Cited

U.S. PATENT DOCUMENTS

| | | | | |
|---|---|---|---|---|
| 6,386,692 | B1 | 5/2002 | Cowger et al. | |
| 6,796,646 | B1 * | 9/2004 | Komplin et al. | 347/86 |
| 6,984,020 | B1 * | 1/2006 | Shinada et al. | 347/49 |
| 2002/0109759 | A1 | 8/2002 | Usui et al. | |
| 2002/0140788 | A1 | 10/2002 | Usui et al. | |

FOREIGN PATENT DOCUMENTS

| | | | |
|---|---|---|---|
| CN | 1241491 | A | 1/2000 |
| CN | 1088012 | C | 7/2002 |
| CN | 1370683 | A | 9/2002 |
| EP | 0 879 703 | A2 | 11/1998 |
| EP | 0 956 965 | A2 | 5/1999 |
| EP | 1 201 438 | A2 | 5/2002 |
| EP | 1 232 871 | A1 | 8/2002 |
| EP | 1 281 528 | A1 | 2/2003 |
| JP | A 2000-218813 | | 8/2000 |

* cited by examiner

*Primary Examiner*—Lamson Nguyen
*Assistant Examiner*—Lisa M. Solomon
(74) *Attorney, Agent, or Firm*—Oliff & Berridge, PLC

(57) ABSTRACT

Ink cartridges have different patterns from each other in positional relationship between projections and insertion parts, respectively, and cartridge holders have different patterns from each other in positional relationship between slits and ink introducing tubes, as seen from the direction on which the ink cartridges are mounted on the cartridge holders, respectively. At the same time, the respective patterns of the positional relationships in the ink cartridges and the cartridge holders coincide with each other per each of the four colors of black, cyan, yellow and magenta. Thus, any one of ink cartridges is prevented from inadvertently joined to any one of the cartridge holders to which the ink cartridge does not correspond to.

19 Claims, 20 Drawing Sheets

SET OF INK CARTRIDGES, INK CARTRIDGE AND INK JET PRINTER

FIELD OF THE INVENTION

The present invention relates to a set of ink cartridges which are filled with a plurality of kinds of inks, ink cartridges included in the set, a method for producing the set of ink cartridges, and an ink jet printer which forms an image with the inks contained in these ink cartridges.

BACKGROUND OF THE INVENTION

In general, an ink jet printer (ink jet recording apparatus) has a construction in which an ink cartridge filled with an ink are adopted to be installed to or mounted on a cartridge case. In such a printer, the ink contained in the ink cartridge mounted on the cartridge case is supplied to a recording head main body through an ink supply needle. (See, for example, Japanese Patent Application Laid-open No. 2000-218813.)

Japanese Patent Application Laid-open No. 2000-218813 discloses an ink jet printer having a cartridge case divided into a larger compartment and a smaller compartment. The larger compartment of the ink cartridge case are provided with three projections in the periphery of respective ink supply needles in an upstanding manner, and the height of the projections is greater than that of ink supply needles. A ink cartridge has three recesses formed in the lower surface thereof for engaging with the three projections of the ink cartridges cases. Accordingly, when the ink cartridges are mounted on the ink cartridge case, it is necessary that the positions of three projections and the positions of three recesses coincide with each other. Otherwise, the ink cartridge cannot be mounted on the ink cartridge case.

Accordingly, by changing the positions in which the projections and recesses are formed or the shape of the projections and recesses per each model of printer, it is possible to ensure that an ink cartridge is mountable only to a cartridge case included in the model of printer to which the ink cartridge corresponds. As a result, it is possible to prevent the ink cartridge from being mounted by mistake on a model of printer to which the ink cartridge does not correspond to.

The countermeasures to prevent such a mis-intallation of ink cartridge are often adopted also for an ink jet printer which performs high-quality color printing with a plurality of ink cartridges each corresponding to different kinds of color inks. In other words, in such a printer, when the user mounts one or more ink cartridge or cartridges on a compartment or compartments of the cartridge case corresponding to the color other than that of the ink cartridge, problems arise such that the inks of different colors are mixed in the cartridge case and the ink cartridge cannot be used. Thus, it is necessary to prevent the ink cartridge of one color from being mounted on the compartment of the cartridge case of color different from that of the ink cartridge. In some cases, ink cartridges having a same shape regardless of the kind of inks are used for such a printer. These ink cartridges are affixed with labels for distinguishing the colors thereof and constructed so that the user cannot mount an ink cartridge of one color on the compartments of ink cartridge case corresponding to a color different from that of the ink cartridge.

As the methods for distinguishing the colors of inks contained in the ink cartridges include, for example, a method to cut a predetermined projection among the plurality of projections provided in the respective surfaces of the ink cartridges, a method to change the shapes of ink cartridges per each of the colors or the positions of insert dies used when the ink cartridges are molded, and a method to attach components for distinguishing colors to the ink cartridges. However, with these methods as described above, problems arise such as one or more extra step or steps in the process for producing the cartridges are required, the mold cost is increased, and/or the number of parts are increased, thereby raising the mold and control costs.

SUMMARY OF THE INVENTION

A primary object of the present invention is to provide a set of ink cartridges and ink cartridge prevented from being mounted in wrong cartridge mounting parts or cartridge holders, and provide an ink jet printer for use with such a set of ink cartridges.

In accordance with a first aspect of the present invention, there is provided a set of plurality of ink cartridges (10*a* to 10*d*) which are mounted on mounting parts (20*a* to 20*d*) of an ink jet printer and which store different inks, wherein:

each of the ink cartridges comprises:

a cartridge body (11*a*, 11*b*, 11*c*, 11*d*, 15*a*, 15*b*, 15*c* or 15*d*);

an ink supplying part (16*a*, 16*b*, 16*c* or 16*d*) provided in the cartridge body; and an engaging part (12*a*, 12*b*, 12*c* or 12*d*) for engaging with one of the mounting parts when an ink cartridge is mounted on the one of mounting parts; and the cartridges have different patterns from each other in positional relationship between the ink supplying part and the engaging part, as seen from a direction (AA) in which the ink cartridges are mounted on the mounting parts.

Thus, the cartridges have different positional relationship between the ink supplying part and the engaging part from each other. This prevents each of the ink cartridges, for example the cartridge storing a black ink, from being mounted on any one of the wrong cartridge mounting parts, for example the cartridge holder connected to the nozzle for ejecting an yellow ink. Each of the plurality of ink cartridges may include a cartridge body and a member which have an engaging part and an ink supplying part respectively formed therein. In one of the ink cartridges, the cartridge body and the member are joined to each other with the engaging and supplying parts arranged in a pattern different from those for the other ink cartridges. In this case, the cartridge bodies and the members of the ink cartridges can be common to all of the ink cartridges, so that the cartridges can be produced at low cost. Each of the mounting parts may have a positioning part for engaging with the engaging part of an associated ink cartridge of the ink cartridges.

In accordance with a second aspect of the present invention, there is provided an ink jet printer (1) on which a plurality of ink cartridges (10*a* to 10*d*) are mounted, the ink cartridges each including a cartridge body (11*a*, 11*b*, 11*c*, 11*d*, 15*a*, 15*b*, 15*c* or 15*d*) and an ink supplying part (16*a*, 16*b*, 16*c* or 16*d*) provided in the cartridge body, the ink cartridges storing different inks, wherein:

the ink jet printer has a plurality of cartridge mounting parts (20*a* to 20*d*) on which the plurality of ink cartridges are mounted, respectively;

each of the cartridge mounting parts includes:

an ink introducing part (21*a*, 21*b*, 21*c* or 21*d*) which is connected to the supplying part of an associated ink cartridge of the ink cartridges and introduces ink thereto; and a positioning part (22*a*, 22*b*, 22*c* or 22*d*) which positions the associated ink cartridge in a predetermined position; and the cartridge mounting parts have different patterns from each other in positional relationship between the ink introducing part and the positioning part, as seen from a direction (AA) in which the ink cartridges are mounted on the mounting parts.

Thus, the cartridge mounting parts have different positional relationships between the ink introducing part and the positioning part from each other. This prevents each of the ink cartridges from being mounted in any one of the wrong cartridge mounting parts.

The positioning parts may be respectively provided in a same position in the cartridge mounting parts. This makes it possible to mount the ink cartridges, with their engaging parts oriented in the same direction.

The ink introducing parts may be respectively provided in a same position in the cartridge mounting parts. This makes it possible to mount the ink cartridges, with their ink supplying parts oriented in the same direction.

The cartridge mounting parts may be arranged in a line. This makes it possible to reduce the width of a portion in which the cartridge mounting parts in the ink jet printer.

In the ink jet printer of the present invention, respective ink introducing parts of two adjacent cartridge mounting parts may be provided close to each other. This makes it possible to arrange the ink introducing parts in a concentrated manner so as to condense the ink channels, thereby reducing the space for the ink channels in the ink jet printer.

The cartridge mounting parts may have four cartridge mounting parts arranged in a form of a lattice. This makes it possible to arrange the cartridge mounting part in a compact manner.

The ink introducing parts of the four cartridge mounting parts may be concentrated inward as seen in the direction in which the ink cartridges are mounted on the cartridge mounting parts. This makes it possible to arrange the ink introducing parts in a concentrated manner so as to condense the ink channels, thereby reducing the space for the ink channels in the ink jet printer.

The ink jet printer may comprise the plurality of ink cartridges. Each of the ink cartridges may include an engaging part for engaging with the positioning part of an associated cartridge mounting part. The cartridge body of each of the ink cartridges may have a first member for containing ink, and a second member; the first member has an engaging part for engaging with the positioning part of an associated cartridge mounting part of the cartridge mounting parts; and a first joining part for joining the first member to the second member; the second member has a second joining part which enables the second member to be joined to the first joining part in one of various orientations; and the ink supplying part provided off the center of the second joining part.

In accordance with a third aspect of the present invention, there is provided an ink cartridge which stores ink to be supplied to an ink jet printer, the cartridge comprising:

a first member (11*a*, 11*b*, 11*c* or 11*d*); and a second member (15*a*, 15*b*, 15*c* or 15*d*) which is joined to the first member, wherein:

the first member has an engaging part (12*a*, 12*b*, 12*c* or 12*d*) for positioning the ink cartridge in a predetermined position in the ink jet printer, and a first joining part (14*a*, 14*b*, 14*c* or 14*d*) for joining the first member to the second member;

the second member (18*a*, 18*b*, 18*c* or 18*d*) has a second joining part which enables the second member to be joined to the first joining part in one of various orientations, and an ink supplying part (16*a*, 16*b*, 16*c* or 16*d*) provided off a center (AX, BX, CX or DX) of the second joining part.

It is possible to produce a plurality of ink cartridges by joining the first and second members of each of the cartridges together, with the associated supplying and engaging parts arranged relative to each other in a pattern different from those for the other cartridges. Accordingly, the first and second members of the ink cartridges can be common to all of them. This reduces the number of parts of the ink cartridges, so that the cartridges can be produced at low cost. Each of the first joining part (14*a* to 14*d*) and the second joining part (18*a* to 18*d*) may be formed with rotational symmetry.

In the ink cartridge of the present invention, the first member may be an ink container, and the second member may be a lid for closing an opening of the ink container. This makes it possible to assemble different ink cartridges from two types of parts. Consequently, the number of parts of the ink cartridges is reduced, so that the cartridges can be produced at low cost.

In the ink cartridge of the present invention, the lid and the opening of the ink container respectively may have a shape of a circle or a regular polygon. This makes it easy to determine different joining postures.

In the ink cartridge of the present invention, the lid and the opening of the ink container respectively may have a shape of a regular polygon, and a number of the plurality of postures in which the lid is joined to the ink container may equal a number of sides of the polygon. This makes it possible to determine different joining positions without using special structure or member.

In the ink cartridge of the present invention, the ink jet printer may include an ink cartridge mounting part in which the ink cartridge is mounted, the ink cartridge mounting part having an ink introducing part provided in a position corresponding to the position of the ink supplying part of the ink cartridge. This makes it possible to supply the ink jet head reliably with the inks in the cartridges mounted on the printer.

It is possible to provide a set of ink cartridges using a plurality of ink cartridges of the present invention. In this case, the ink cartridges may be assembled with the first and second joining parts joined in different orientations. In the thus obtained set of ink cartridges, the ink cartridges may have different positional relationships between the ink supplying part and the engaging part from each other. This makes it possible to assemble different ink cartridges from the same parts.

In accordance with a fourth aspect of the present invention, there is provided a method for producing such a set of ink cartridges, the method comprising the steps of:

assembling a first ink cartridge (10*a*) by joining the first joining part (14*a*) of the first member (11*a*) of the first ink cartridge and the second joining part (18*a*) of the second member (15*a*) of the first ink cartridge together in a predetermined orientation; and assembling a second ink cartridge (10*b*) by joining the first joining part (14*b*) of the first member (11*b*) of the second ink cartridge and the second joining part (18*b*) of the second member (15*b*) of the second ink cartridge together in another orientation different from the predetermined orientation.

In this case, the first and second joining parts may be in rotational symmetry.

DESCRIPTION OF THE PREFERRED EMBODIMENTS OF THE INVENTION

First Embodiment

Figure 1:
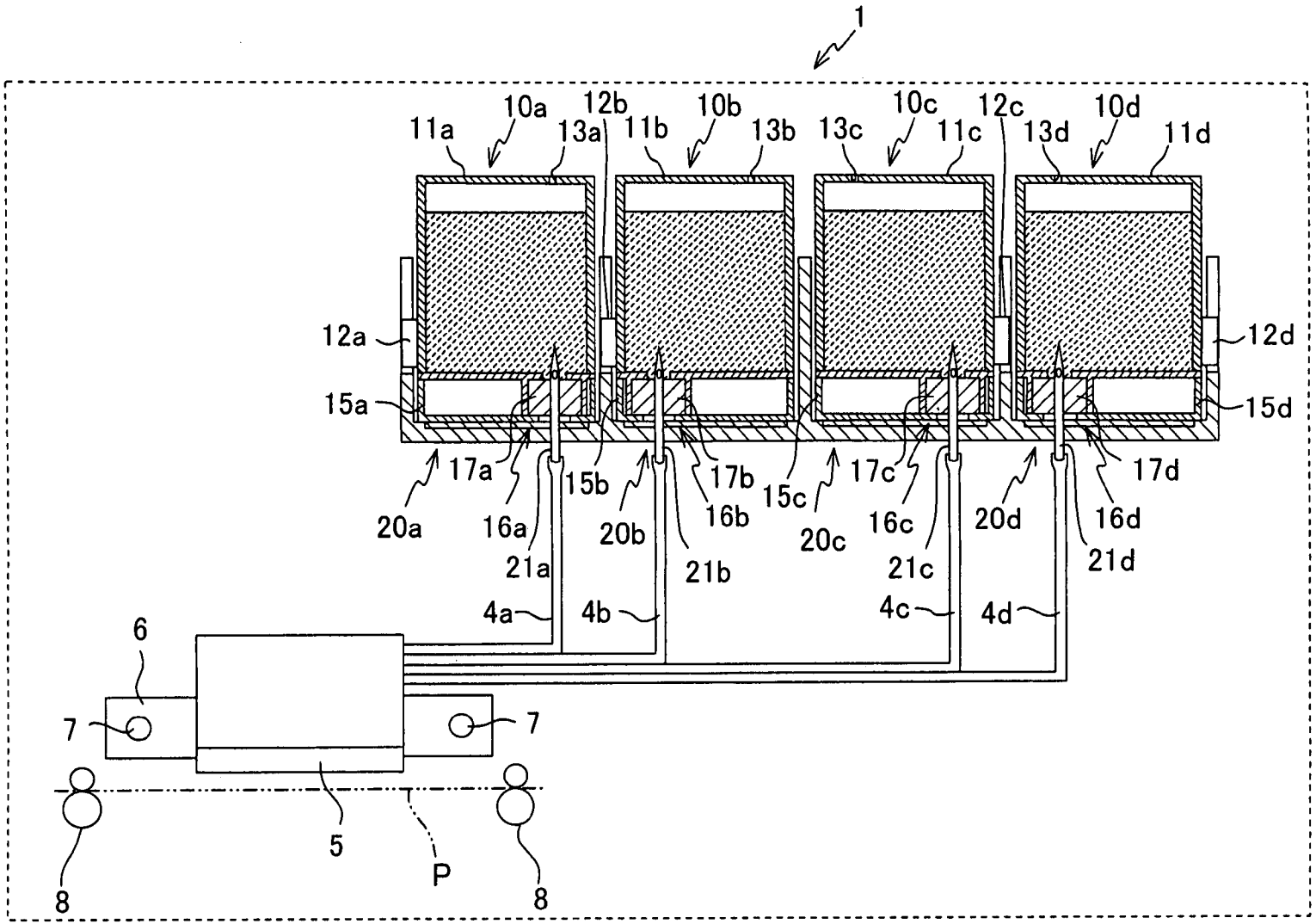
FIG. 1 shows a schematic arrangement of an ink jet printer according to a first embodiment of the invention.

An explanation will be made regarding the preferred embodiments of the present invention. FIG. 1 shows a schematic arrangement of an ink jet printer 1 according to a first embodiment of the present invention.

The printer 1 includes a plurality of ink cartridges 10*a* to 10*d* filled with inks of black, cyan, yellow and magenta colors, respectively; cartridge receiving parts or cartridge holders 20*a* to 20*d* on which the ink cartridges 10*a* to 10*d* are detachably mounted; an ink jet head 5 (hereinafter referred to simply as "head 5) which discharges ink onto paper P, the inks being supplied to the head 5 from the ink cartridges 10*a* to 10*d* mounted on the cartridge holders 20*a* to 20*d* through supplying tube 4*a* to 4*d*, respectively; a carriage 6 in which the head 5 is mounted and which reciprocates in a linear direction along a carriage shaft 7 which serves as a guide when the carriage 6 makes the reciprocating motion; and a transport mechanism 8 which transports the paper P.

The ink cartridges 10*a* to 10*d* include ink containers 11*a* to 11*d* which stores the ink, and lids 15*a* to 15*d* joined thereto, respectively. Projections 12*a* to 12*d* are provided in the outer circumferential surface of the ink containers 11*a* to 11*d*, respectively. In the lids 15*a* to 15*d*, insertion parts 16*a* to 16*d* are provided for receiving ink introducing tubes 21*a* to 21*d*. Plugs 17*a* to 17*d*, which seal the inner space of the ink cartridges 10*a* to 10*d*, respectively, are compressed into the insertion parts 16*a* to 16*d*. The inner side surface of the respective plugs 17*a* to 17*d* make contact with the ink contained in the respective ink cartridges 10*a* to 10*d*. Air holes 13*a* to 13*d* are formed in the closed surfaces (upper surfaces in FIG. 1) of the ink containers 11*a* to 11*d*, respectively.

The cartridge holders 20*a* to 20*d* are parts on which the ink cartridges 10*a* to 10*d* are mounted, respectively. In the respective bottom surfaces of the cartridge holders 20*a* to 20*d*, hollow needle-shaped ink introducing tubes 21*a* to 21*d* are provided to protrude therethrough the bottom surfaces.

When the cartridges 10*a* to 10*d* are mounted on the cartridge holders 20*a* to 20*d*, respectively, the tips of the ink-introducing tubes 21*a* to 21*d* pierce the plugs 17*a* to 17*d*, respectively, and are entered inside the ink cartridges 10*a* to 10*d*, thereby making contact with the respective inks in the ink cartridges 10*a* to 10*d*. Since each of the plugs 17*a* to 17*d* is formed of an elastic material like butyl rubber so that the ink-introducing tubes 21*a* to 21*d* are capable of piercing the plugs 17*a* to 17*d* and the plugs 17*a* to 17*d* are compressed into the insertion parts 16*a* to 16*d*, the elastic function of the plugs maintains the tightly sealed or closed condition in the ink containers 11*a* to 11*d* even after the ink introducing tubes 21*a* to 21*d* are pulled out.

As described above, when the ink is discharged from the head 5 to the paper P after the ink cartridges 10*a* to 10*d* are mounted on the cartridge holders 20*a* to 20*d*, respectively, the ink, which corresponds to the discharged amount, is supplied from each of the ink cartridges 10*a* to 10*d* to the head 5 through the respective supply tubes 4*a* to 4*d*. At this time, the air is introduced into the ink cartridges 10*a* to 10*d* from the air holes 13*a* to 13*d* of the ink containers 11*a* to 11*d*, respectively.

The head 5 has a plurality of nozzles (not shown) which discharges the ink. Accordingly, the ink, supplied from the ink cartridges 10*a* to 10*d* to the head 5 through the supply tubes 4*a* to 4*d*, are discharged from the plurality of nozzles. During the printing operation, the ink is discharged while the carriage 6 reciprocates the printing of the printing paper P.

Figure 2:
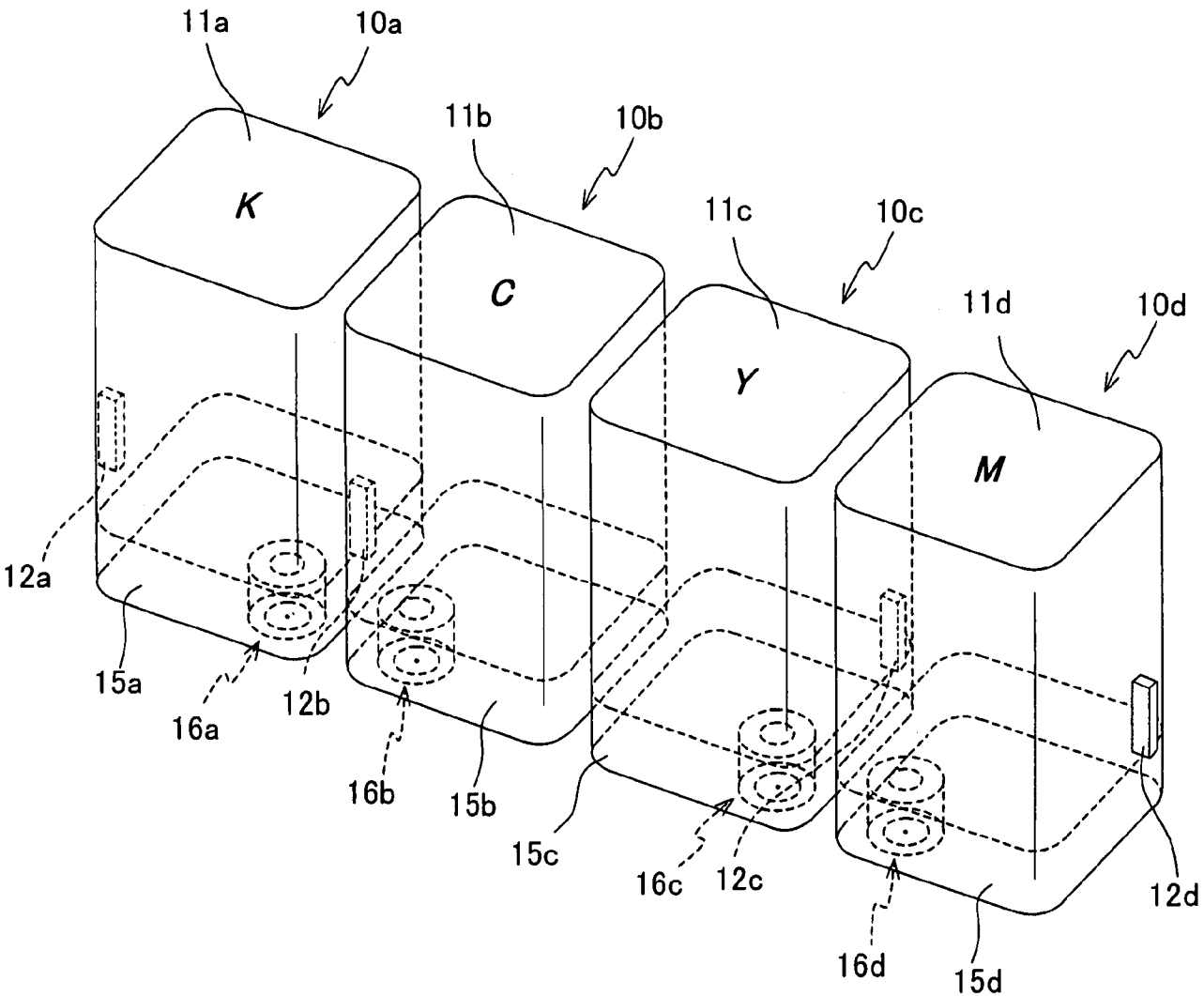
FIG. 2 is a perspective view of ink cartridges 10*a* to 10*d;*
Figure 3:
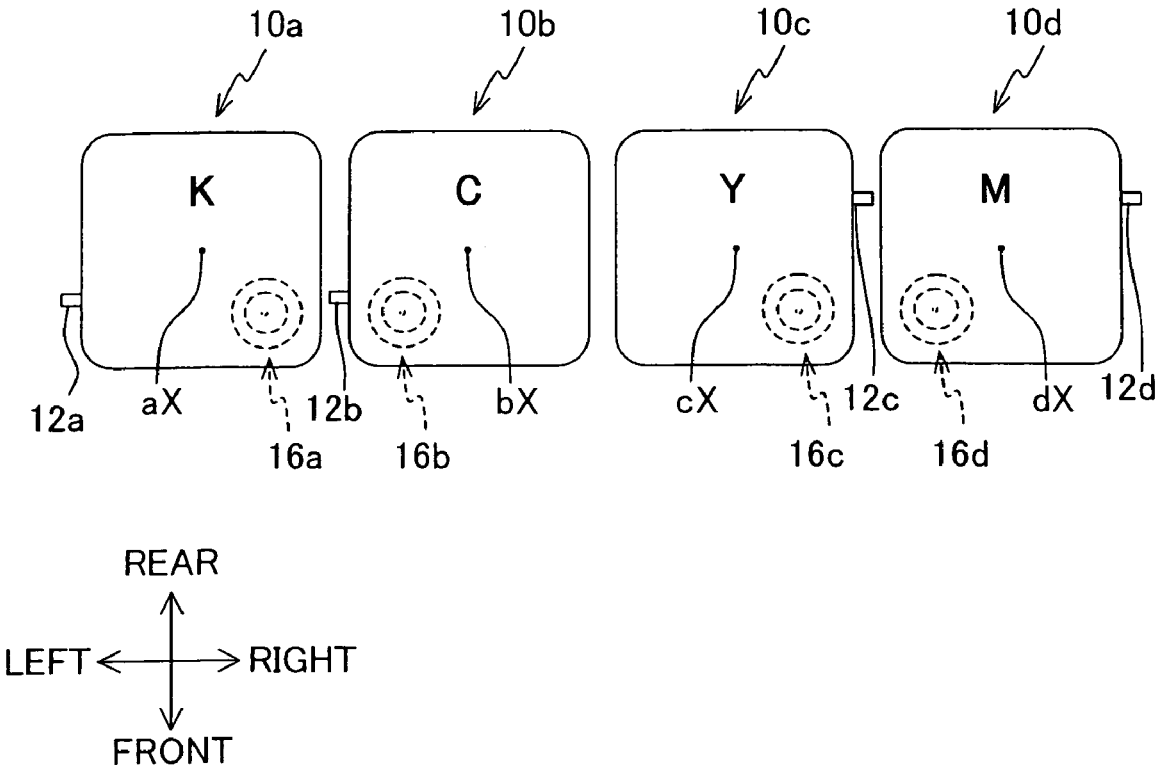
FIG. 3 is a top view of the ink cartridges 10*a* to 10*d;*
Figure 4A:
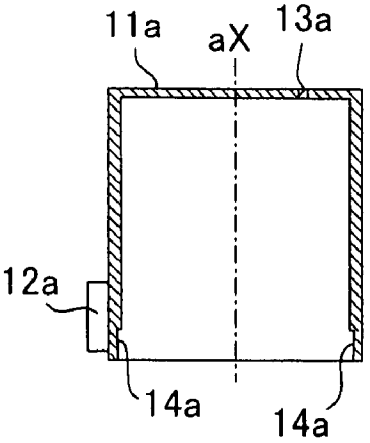
FIG. 4A is a vertical cross section of the ink container 11*a* of the black ink cartridge 10*a* shown in FIGS. 2 and 3.
Figure 4B:
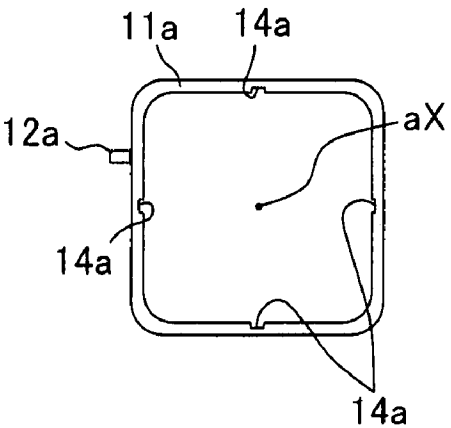
FIG. 4B is a bottom view of the ink container 11*a;*
Figure 4C:
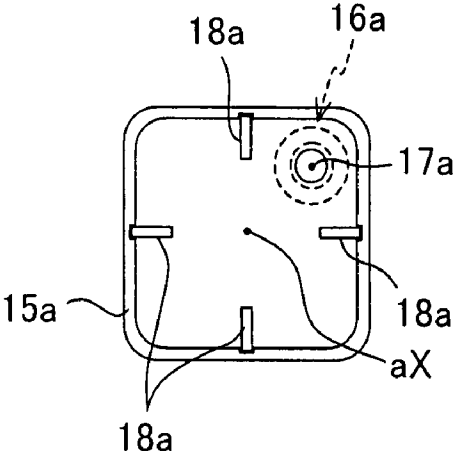
FIG. 4C is a top view of the lid 15*a* of the black ink cartridge shown in FIGS. 2 and 3.
Figure 4D:
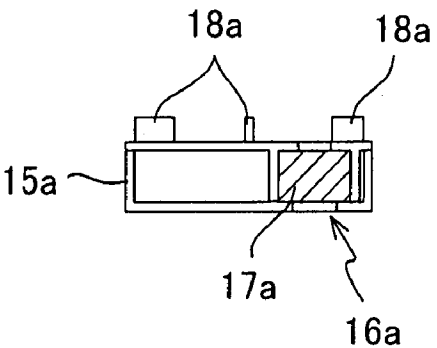
FIG. 4D is a vertical cross section of the lid 15*a;*
Figure 4E:
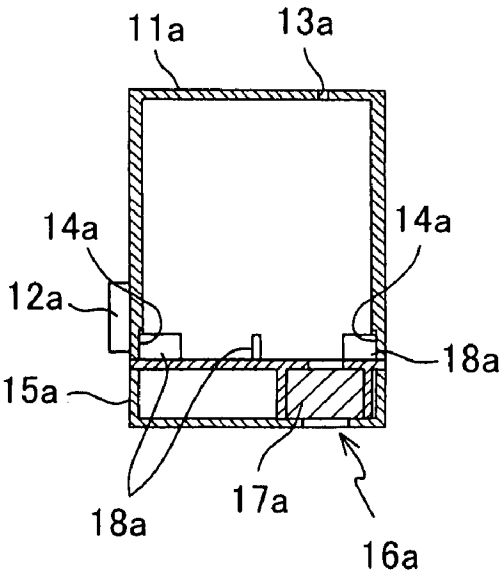
FIG. 4E is a vertical cross section of the black ink cartridge 10*a* shown in FIGS. 2 and 3.

Next, an explanation will be made regarding a detailed construction of the ink cartridges 10*a* to 10*d* with reference to FIGS. 2, 3 and 4A to 4E. FIG. 2 is a perspective view and FIG. 3 is a top view of the ink cartridges 10*a* to 10*d*. FIG. 4 is a diagram showing a schematic arrangement of the ink container 11*a* and the lid 15*a* included in the ink cartridge 10*a* corresponding to the black color. Specifically, FIG. 4A shows a vertical cross section of the ink container 11*a*, FIG. 4B shows a horizontal cross section and bottom view of the ink container 11*a*, FIG. 4C shows a top view of the lid 15*a*, and FIG. 4D shows a vertical cross section of the lid 15*a*. FIG. 4E shows a vertical cross section of the ink cartridge 10*a* in which the ink container 11*a* and the lid 15*a* are joined to each other.

As described above, in ink cartridge 10*a*, the ink container 11*a* and the lid 15*a* are joined to each other. As shown in FIGS. 2 and 4, the ink container 11*a* is a tubular member which is substantially square in horizontal cross section. The projection 12*a* is provided near one corner of the container 11*a*. The top of the ink container 11*a* is closed except for the portion where the air hole 13*a* (not shown in FIGS. 2 to 4) is formed. The bottom of the ink container 11*a* is open.

As shown in FIGS. 4A and 4B, four recesses 14*a* (first joining parts) are formed in the bottom (the end portion on the open side) of the ink container 11*a*. In the respective inner side surfaces of the bottom at the four side surfaces of the ink container 11*a*, the recesses 14*a* are arranged in the center of the respective inner side surfaces. In other words, the recesses 14*a* have rotational symmetry with the center (axis) aX in the bottom of the ink container 11*a*, the portions corresponding to the recesses 14*a* are thin.

The lid 15*a* closes an opening of the bottom of the ink container 11*a*, and the projected configuration of the lid 15*a* is approximately same as that of the ink container 11*a*. The insertion part 16*a* of the lid 15*a* is arranged near one corner of the lid. As shown in FIGS. 4C and 4D, four ribs 18*a* (second joining parts) are provided on the upper surface (surface joined to the ink container 11*a*) of the lid 15*a* to protrude upwardly therefrom. The four ribs 18*a* are formed in the vicinity of the outer periphery of the lid 15*a*, and are positioned in the center of the resepctive four side surfaces of the lid 15*a*. As a result, these ribs 18*a* are in rotational symmetry with the center aX of the lid 15*a*. The outer end portion of each rib 18*a* is spaced by a predetermined distance from the outer periphery of the lid 15*a* toward the inner side of the lid 15*a*. The predetermined distance is approximately equal to the thickness of the thinned portion in the bottom of the ink container 11*a*.

The width and height of the four recesses 14*a* of the container 11*a* are approximately equal to those of the outer end portion of the ribs 18*a* of the lid 15*a*. Accordingly, when the lid 15*a* is joined to the container 11*a*, it is possible to engage the outer end of the rib 18*a* into the recess 14*a*. The four recesses 14*a* and the four outer ends of the ribs 18*a* are same in shape, and are formed at identical angular intervals. Further, these recesses 14*a* are in rotational symmetry with the center aX of the ink container 11*a*. Accordingly, when the lid 15*a* is joined to the ink container 11*a*, it is possible to join the lid 15*a* to the ink container 11*a* in any one of four joining postures by turning the lid 15*a* by 90 degrees for each of the four postures.

FIG. 4E shows the ink cartridge 10*a* corresponding to the black color, which is formed by joining the lid 15*a* to the ink container 11*a* in one of the four joining postures relative to the ink container 11*a*.

The ink containers 11*a* to 11*d* constructing the ink cartridges 10*a* to 10*d* corresponding to the black, cyan, yellow and magenta colors, respectively, and the lids 15*a* to 15*d* are same in structure. As shown in FIGS. 2 and 3, the joining postures of the lids 15*a* to 15*d* to the respective ink containers 11*a* to 11*d* are different from each other in the ink cartridges 10*a* to 10*d* when the lids 15*a* to 15*d* are joined to the respective ink containers 11*a* to 11*d*. Thus, the set of ink cartridges of the present invention is produced by joining the lids 15*a* to 15*d* to the ink containers 11*a* to 11*d*, respectively in this manner.

FIG. 3 shows a top view of the ink cartridges 10*a* to 10*d* produced by joining the lids 15*a* to 15*d* in the respective four joining postures to the ink containers 11*a* to 11*d*, respectively. In FIG. 3, front/near and left/right directions are indicated by arrows for explanation of configuration of the cartridges 10*a* to 10*d*.

As shown in FIG. 3, in the ink cartridge 10*a* corresponding to the black color, the projection 12*a* is arranged in a position off the center of the left side surface toward the front side. The insertion part 16*a* is arranged in a position in the vicinity of the right side surface opposed to the left side surface where the projection 12*a* is arranged, and off the center aX of the ink cartridge 10*a* toward the front-right corner thereof. On the other hand, in the ink cartridge 10*b* corresponding to the cyan color, the projection 12*b* is arranged, as in the case of the projection 12*a*, in a position off the center of the left side surface toward the front side. The insertion part 16*b* is arranged in a position in the vicinity of the left side surface where the projection 12*b* is arranged, and off the center bX of the ink cartridge 10*b* toward the front-light corner thereof.

Similarly, in the ink cartridge 10*c* corresponding to the yellow color, the projection 12*c* is arranged in a position off the center of the right side surface toward the rear side. The insertion part 16*c* is arranged, as in the case of the insertion part 16*a*, in a position in the vicinity of the right side surface where the projection 12*c* is arranged, and off the center cX of the ink cartridge 10*c* toward the front-right corner thereof. On the other hand, in the ink cartridge 10*d* corresponding to the magenta color, the projection 12*d* is arranged, as in the case of the projection 12*c*, in a position off the center of the right side surface toward the rear side. The insertion part 16*d* is arranged, as in the case of the insertion part 16*b*, in a position in the vicinity of the left side surface opposed to the right side where the projection 12*d* is arranged, and off the center dX of the ink cartridge 10*d* toward the front-left corner thereof.

As shown in FIG. 3, in the ink cartridges 10*a* to 10*d*, the insertion parts 16*a* to 16*d* are positioned respectively eccentric from (arranged off) the center aX to dX of the ink cartridges 10*a* to 10*d*, respectively.

Thus, FIG. 3 shows the ink cartridges 10*a* to 10*d* corresponding to the black, cyan, yellow and magenta colors respectively in this order from the left side to the right side. However, the projections 12*a* to 12*d* are arranged differently relative to the corresponding insertion parts 16*a* to 16*d* around the centers aX to dX of the associated ink cartridges 10*a* to 10*d*. In other words, the respective patterns of the positional relationship between the proejctions 12*a* to 12*d* and the insertion parts 16*a* to 16*d*, respectively, are different from each other seen from a direction in which the ink cartridges 10*a* to 10*d* are mounted (as seen from the direction of arrow AA in FIG. 5).

Figure 5:
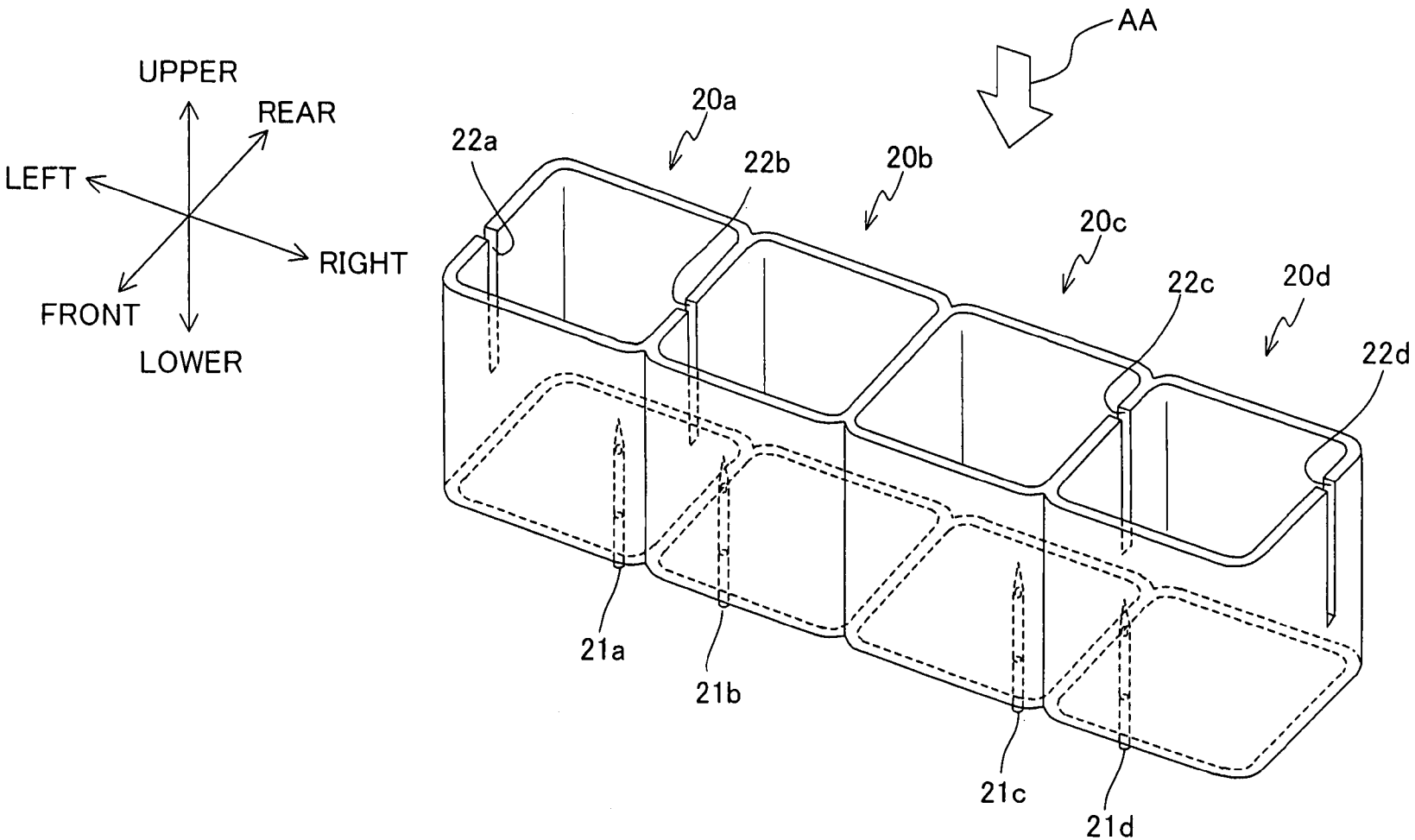
FIG. 5 is a perspective view of the cartridge receiving parts or cartridge holders 20*a* to 20*d* shown in FIG. 1.
Figure 6:
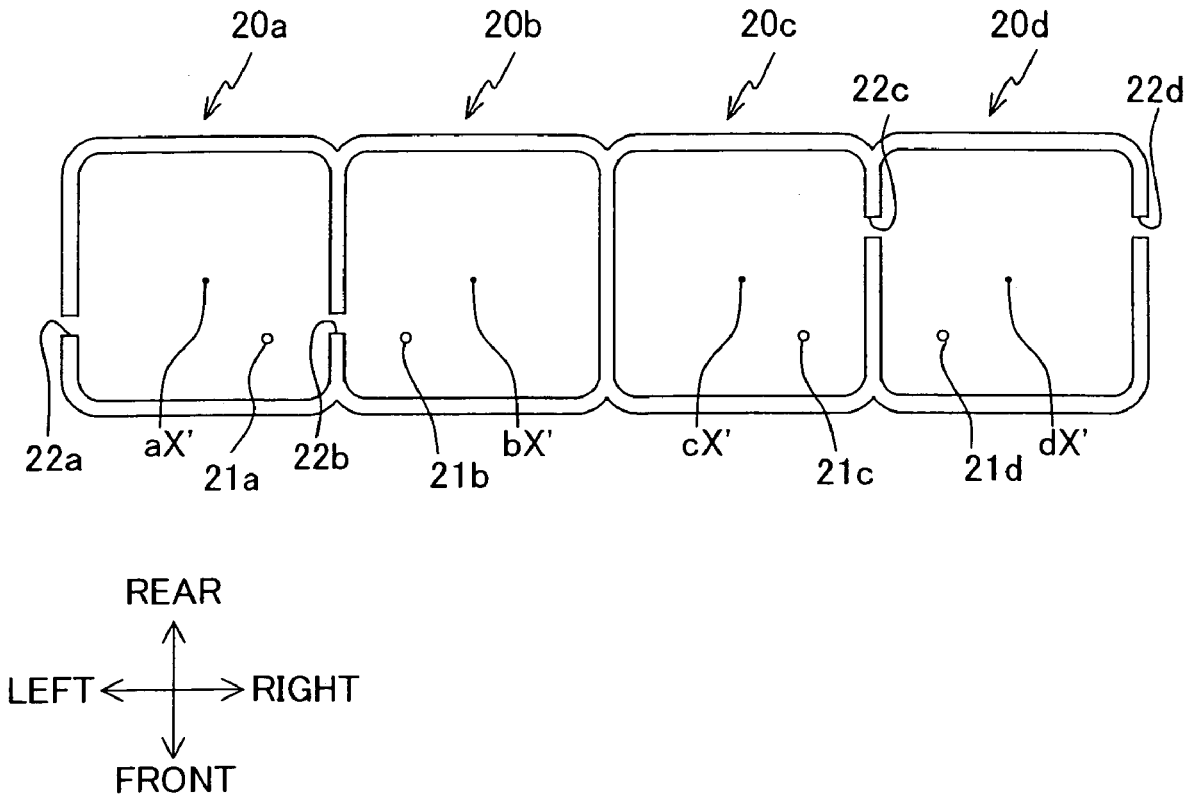
FIG. 6 is a top view of the cartridge holders 20*a* to 20*d;*
Figure 7:
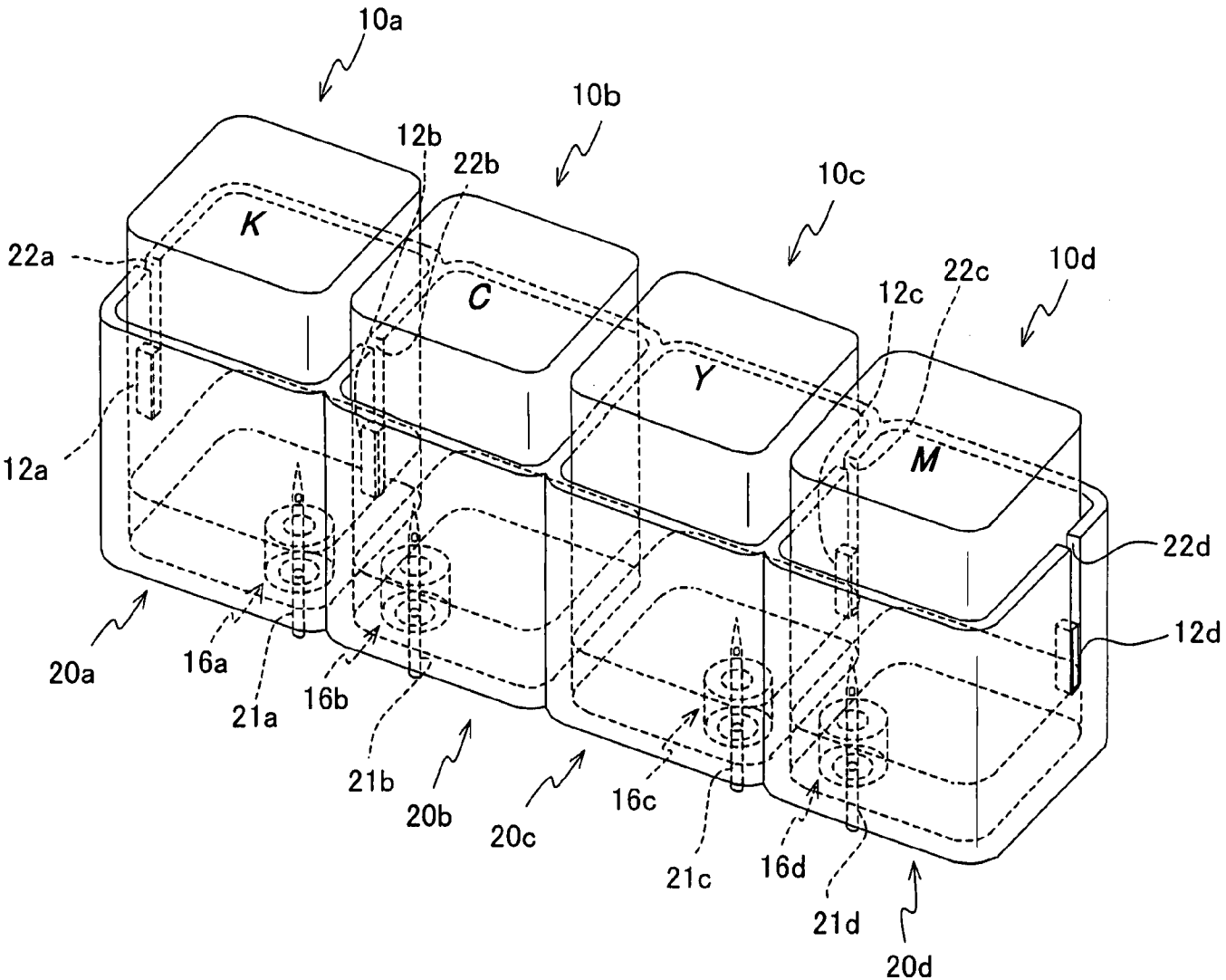
FIG. 7 is a perspective view of a state in which the ink cartridges 10*a* to 10*d* are mounted on the cartridge holders 20*a* to 20*d*, respectively.
Figure 8:
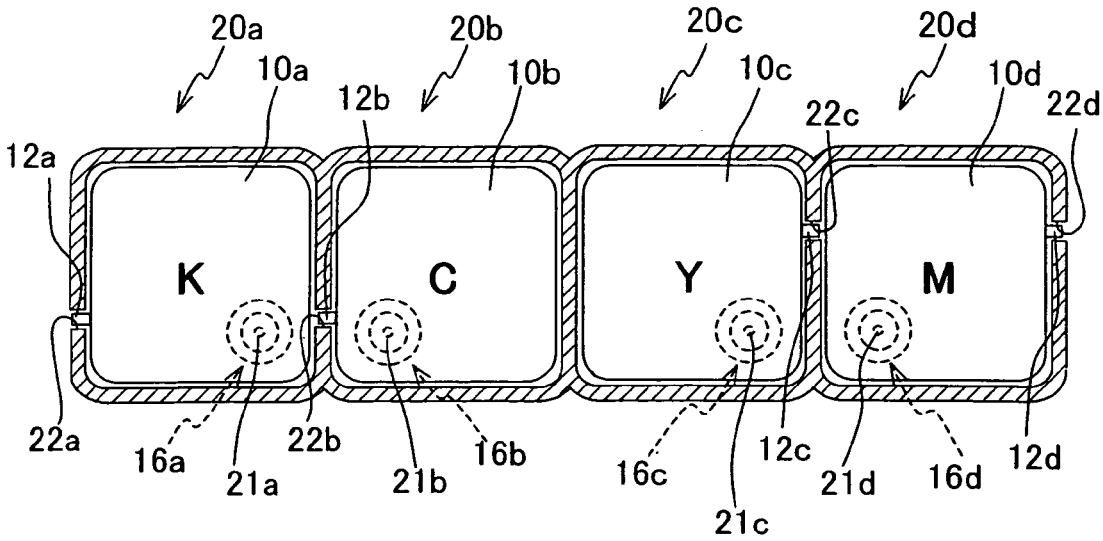
FIG. 8 is a top view of a state in which the ink cartridges 10*a* to 10*d* are mounted on the cartridge holders 20*a* to 20*d*, respectively.

Next, an explanation will be made regarding a detailed construction of the cartridge holders 20*a* to 20*d* with reference to FIGS. 5 to 8. FIGS. 5 and 6 are perspective and top views of the cartridge holders 20*a* to 20*d*, respectively. FIGS. 7 and 8 are perspective and top views showing a state in which the ink cartridges 10*a* to 10*d* are mounted on the cartridge holders 20*a* to 20*d*, respectively. In FIG. 5, the upper/lower, front/rear and left/right directions corresponding to the view of FIG. 3 are shown by arrows for explanation of the configuration of the cartridge holders 20*a* to 20*d*.

As shown in FIG. 5, the cartridge holders 20*a* to 20*d* have a substantially box-shaped member for mounting the ink cartridges 10*a* to 10*d* thereon, respectively. The cartridge holders 20*a* to 20*d* are arranged in a line. The cross sectional area of the inner space of the respective cartridge holders 20*a* to 20*d* is approximately same as that of the cross sectional area of the ink cartridges 10*a* to 10*d*. In this embodiment, the cartridge holders 20*a* to 20*d* are integrally formed and constructed with one member.

As described above, the ink introducing tubes 21*a* to 21*d* are provided in the bottom surface of the cartridge holders 20*a* to 20*d* to protrude upwardly therefrom. In the cartridge holders 20*a* to 20*d*, the ink introducing tubes 21*a* to 21*d* are positioned respectively eccentric from (arranged off) the center of the bottom surface. The tips of the ink introducing tubes 21*a* to 21*d* are located in the vicinity of the middle of the cartridge holders 20*a* to 20*d* in the height thereof, respectively.

In the two adjacent cartridge holders 20*a*, 20*b*, the ink introducing tubes 21*a*, 21*b* are provided close to each other. Similarly, in the two adjacent cartridge holders 20*c*, 20*d*, the ink introducing tubes 21*c*, 21*d* are provided close to each other.

The cartridge holders 20*a* to 20*d* have slits 22*a* to 22*d* formed on side surfaces, respectively. The projections 12*a* to 12*d* of the ink containers 11*a* to 11*d* are engaged with the slits 22*a* to 22*d*, respectively. The slits 22*a* to 22*d* extend downwardly from the respective tops of the cartridge holders 20*a* to 20*d* toward the vicinity of the middle in the height thereof.

As shown in FIG. 6, in which front/near and left/right directions are indicated by arrows for explanation of configuration of the cartridge holders 20*a* to 20*d*, the slit 22*a* is arranged in a position off the center of the left side surface toward the front side in the cartridge holder 20*a* corresponding to the black color. The ink introducing tube 21*a* is arranged in a position in the vicinity of the right side surface opposed to the left side surface where the slit 22*a* is arranged, and off the center aX'of the cartridge holder 20*a* toward the front-right corner thereof. On the other hand, in the cartridge holder 20*b* corresponding to the cyan color, the slit 22*b* is arranged, as in the case of the slit 22*a*, in a position off the center of the left side surface toward the front side. The ink introducing tube 21*b* is arranged in a position in the vicinity of the left side surface where the slit 22*b* is also arranged and off the center bX' of the cartridge holder 20*b* toward the front-left corner thereof.

Similarly, as shown in FIG. 6, in the cartridge holder 20*c* corresponding to the yellow color, the slit 22*c* is arranged in a position off the center of the right side surface toward the rear side. The ink introducing tube 21*c* is arranged, as in the case of the ink introducing tube 21*a*, in a position in the vicinity of the right side surface where the slit 22*c* is arranged, and off the center cX' of the cartridge holder 20*c* toward the front-right corner thereof. On the other hand, in the cartridge holder 20*d* corresponding to the magenta color, the slit 22*d* is arranged, as in the case of the slit 22*c*, in a position off the center of the right side surface toward the rear side. The ink introducing tube 21*d* is arranged, as in the case of the ink introducing tube 21*b*, in a position in the vicinity of the left side surface opposed to the right side surface where the slit 22*d* is arranged, and off the center dX' of the cartridge holder 20*d* toward the front-left corner thereof.

Thus, FIG. 5 shows the cartridge holders 20*a* to 20*d* for the ink cartridges 10*a* to 10*d* corresponding to the black, cyan, yellow and magenta colors respectively in this order from the left side to the right side. However, each of the slits 22*a* to 22*d* is arranged differently relative to the corresponding ink introducing tubes 21*a* to 21*d* around the centers aX' to dX' of the associated cartridge holders 20*a* to 20*d*. In other words, the respective patterns of the positional relationship between the slits 22*a* to 22*d* of the cartridge holders 20*a* to 20*d* and the ink introducing tubes 21*a* to 21*d*, respectively, are different from each other, as seen from a direction in which the ink cartridges 10*a* to 10*d* are mounted (as viewed from the direction of arrow AA in FIG. 5).

As understood from the foregoing explanation, the respective patterns of positional relationship between the projections 12*a* to 12*d* and the insertion parts 16*a* to 16*d* of the ink cartridge 10*a* to 10*d* and the respective patterns of positional relationship between the slits 22*a* to 22*d* of the cartridge holders 20*a* to 20*d* and the ink introducing tubes 21*a* to 21*d* are same per each of the colors of black, cyan, yellow and magenta. Accordingly, as shown in FIGS. 7 and 8, it is possible to appropriately mount the cartridges 10*a* to 10*d* on the cartridge holders 20*a* to 20*d*, respectively, without any misfit by the user.

For example, an consideration is made regarding the movement when the ink cartridge 10*a* corresponding to the black color is mounted on the cartridge holder 20*a* corresponding to the black color. When the ink cartridge 10*a* is moved over the cartridge holder 20*a*, and the projection 12*a* is engaged with the slit 22*a* and entered toward the bottom surface of the cartridge holder 20*a*, the position of the ink introducing tube 21*a* coincides with the position of the insertion part 16*a*. Accordingly, when the ink cartridge 10*a* is continuously entered toward the bottom surface of the cartridge holder 20*a*, the ink introducing tube 21*a* is capable of entering into the insertion part 16*a*. Thus, it is possible to mount ink cartridge 10*a* on the cartridge holder 20*a*.

On the other hand, an consideration is made regarding the movement when the ink cartridge 10*a* corresponding to the black color is mounted on one of the cartridge holders 20*b* to 20*d* corresponding to the colors other than black. When the ink cartridge 10*a* is moved over any one of the cartridge holders 20*b* to 20*d*, and the projection 12*a* is engaged with any one of the slits 22*b* to 22*d* and entered toward the bottom surface of any one of the cartridge holders 20*b* to 20*d*, the position of any one of the ink introducing tubes 21*b* to 21*d* does not coincide with the position of the insertion part 16*a*. Accordingly, when the ink cartridge 10*a* is continuously entered toward the bottom surface of any one of the cartridge holders 20*b* to 20*d*, any one of the ink introducing tubes 21*b* to 21*d* abuts against the portion other than the insertion part 16*a* in the bottom surface of the ink cartridge 10*a*. Thus, it is impossible to mount the ink cartridge 10*a* on any one of the cartridge holders 20*b* to 20*d*.

As a result, as shown in FIG. 8, only when the ink cartridges 10*a* to 10*d* corresponding to the black, cyan, yellow and magenta colors are mounted on the corresponding cartridge holders 20*a* to 20*d*, respectively, the projections 12*a* to 12*d* are engaged with the slits 22*a* to 22*d*, respectively, and the ink introducing tubes 21*a* to 21*d* are entered in the insertion parts 16*a* to 16*d*, respectively, thereby realizing the appropriate mount.

As described above, in the ink jet printer 1 of this embodiment, as seen from the direction in which the ink cartridges 10*a* to 10*d* are mounted (in the case of FIG. 8, seen from above the sheet surface of the drawing), the respective patterns of positional relationship between the projections 12*a* to 12*d* and the insertion parts 16*a* to 16*d*, respectively, are different from each other, and the respective patterns of the positional relationship between the slits 22*a* to 22*d* of the cartridge holders 20*a* to 20*d* and the ink introducing tubes 21*a* to 21*d* are different from each other. However, the respective patterns of the positional relationships in the ink cartridges and the cartridge holders coincide with each other per each of the four colors of black, cyan, yellow and magenta. In this manner, by making the positional relationship between the projections 12*a* to 12*d* and the insertion parts 16*a* to 16*d* in the ink cartridges 10*a* to 10*d* and the positional relationship between the slits 22*a* to 22*d* and the ink introducing tubes 21*a* to 21*d* in the cartridge holders 20*a* to 20*d* different from each other per each of a plurality of different colors, it is possible to prevent any one of the ink cartridges 10*a* to 10*d* from inadvertently being mounted on any one of the cartridge holders 20*a* to 20*d* to which the ink cartridge does not correspond to.

In addition, it is possible to produce the ink cartridges 10*a* to 10*d* by joining the projections 12*a* to 12*d* to the insertion parts 16*a* to 16*d* in four different joining postures, respectively, by turning the lids 15*a* to 15*b* by 90 degrees about the centers aX to dX. Accordingly, it is possible to commonly use the ink containers 11*a* to 11*d* and the lids 15*a* to 15*d*, which are same in construction respectively, for all of the ink cartridges 10*a* to 10*d*. Therefore, it is possible to produce four kinds of the ink cartridges 10*a* to 10*d* with one kind of the ink container and one kind of the lid, thereby reducing the production cost.

In addition, since the cartridge holders 20*a* to 20*d* are arranged in a line, it is possible to reduce the width of a part in the printer 1 where the cartridge holders 20*a* to 20*d* are provided.

Further, in the two adjacent cartridge holders 20*a*, 20*b*, the ink introducing tubes 21*a*, 21*b* are provided close to each other, and in the two adjacent cartridge holders 20*c*, 20*d*, the ink introducing tubes 21*c*, 21*d* are provided close to each other. Therefore, it is possible to reduce the size of the part constructing an ink flow path in the printer 1.

Since the ink containers 11*a* to 11*d* and the lids 15*a* to 15*d* are square in horizontal section and thus are in rotational symmetry, it is easy to determine a plurality of joining postures therefor. The number of postures in which the lids 15*a* to 15*d* can be joined to the ink containers 11*a* to 11*d* equals the number of sides of regular quadrilateral. Accordingly, it is possible to join the lids 15*a* to 15*d* to the containers 11*a* to 11*d* in different postures without using special structure or member.

In a case in which the patterns of positional relationship between the engaging parts and the insertion parts of a plurality of ink cartridges are same, the colors corresponding to the respective ink cartridges are distinguished by complexly constructing the respective shape of the engaging parts so as to be different from each other. Compared with such a case, in this embodiment, it is unnecessary to complexly construct the respective shapes of the projections 12*a* to 12*d* since the respective patterns of positional relationship between the projections 12*a* to 12*d* and the insertion parts 16*a* to 16*d* of the ink cartridges 10*a* to 10*d* are different from each other. In addition, in a case where the shape of the engaging part is complex, the engaging part tends to be easily broken and it is difficult to engage the engage part with the positioning part of cartridge holder. However, with this embodiment, such problems do not arise.

In this embodiment, the lid 15*a* is joined to the ink container 11*a* by engaging the outer end portion of the rib 18*a* to the recess 14*a*. However, in place of the rib 18*a* and the recess 14*a*, any arbitrary joining construction may be adopted in which the lid 15*a* is joined to the ink container 11*a*. For example, the circumference of the top of the lid 15*a* may extend upwardly to have a frame-shaped form which is engageable with the bottom of the ink container 11*a*. In this case, the top of the lid 15*a* and the bottom of the ink container 11*a* construct the respective joining parts, and as in the case in which the lib 18*a* and the recess 14*a* are provided, it is possible to construct four different kinds of ink cartridges with the four kinds of patterns for engaging the lid 15*a* to the ink container 11*a*. In other words, the outer shape having a quadrangular form of the lid 15*a* and ink container 11*a* determines the four engaging patterns in any one of which the lid 15*a* and the ink container 11*a* can be joined together.

Second Embodiment

Figure 9:
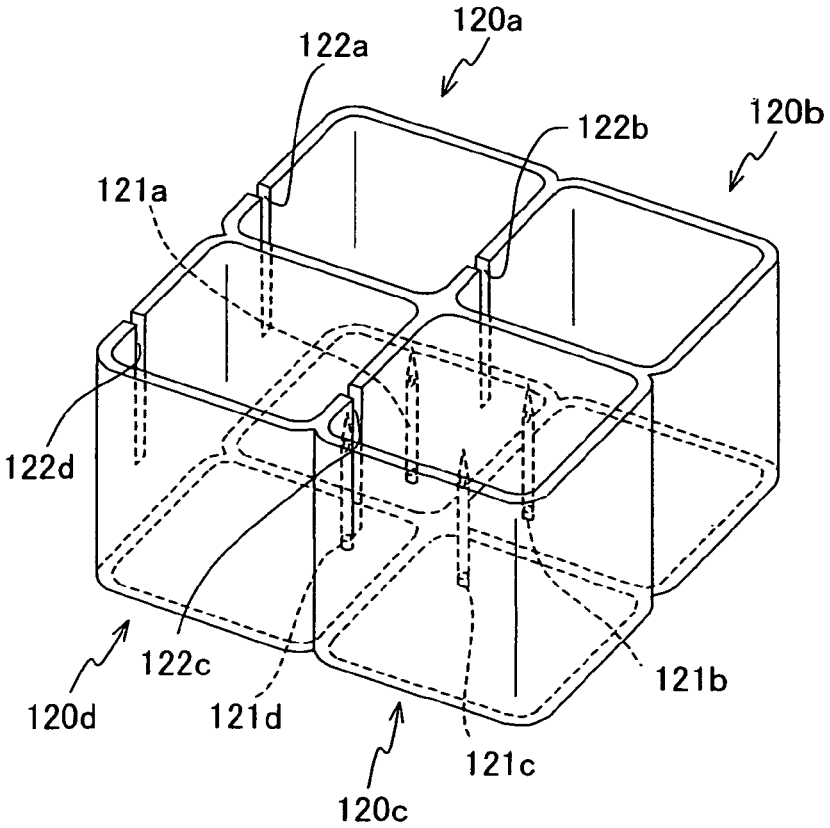
FIG. 9 is a perspective view of the cartridge holders 120*a* to 120*d* of an ink jet printer according to a second embodiment of the invention.
Figure 10:
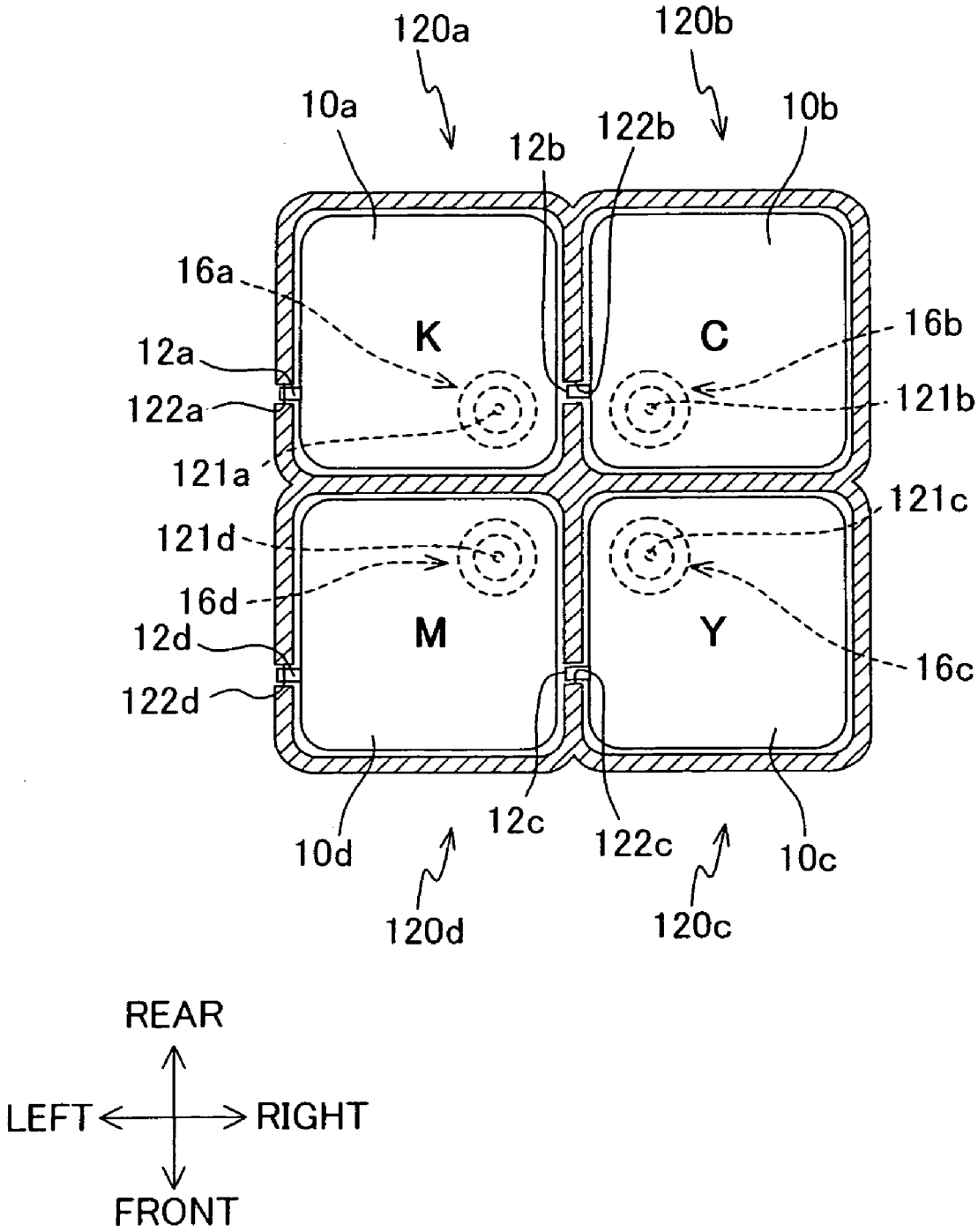
FIG. 10 is a top view of the cartridge holders 120*a* to 120*d* with the ink cartridges 120*a* to 120*d* mounted thereon.

Next, an explanation will be made regarding an ink jet printer of the second embodiment of the present invention with reference to FIGS. 9 and 10. FIG. 9 shows a perspective view of a cartridge holders 120*a* to 120*d* included in an ink jet printer according to the second embodiment. FIG. 10 shows a top view illustrating a state in which the ink cartridge 10*a* to 10*d* are mounted on the cartridge holder 120*a* to 120*d*, respectively. In FIG. 10, front/near and left/right directions are indicated by arrows for explanation of configuration of the cartridges 120*a* to 120*d*.

The ink jet printer according to the second embodiment differs from the ink jet printer according to the first embodiment principally in that the cartridge holders 120*a* to 120*d* in the second embodiment are arranged in a form of a lattice, whereas the ink cartridge holders 20*a* to 20*d* included in the ink jet printer 1 of the first embodiment are arranged in a line. Since the construction of the ink jet printer of the second embodiment other than the above are same as the ink jet printer 1 of the first embodiment, the detailed explanation thereof will be omitted.

The ink cartridge holders 120*a* to 120*d*, corresponding to the black, cyan, yellow and magenta colors respectively, have a substantially box-shaped member for mounting the ink cartridges 10*a* to 10*d* thereon, respectively. As shown in FIGS. 9 and 10, the cartridge holders 120*a* to 120*d* are arranged in the form of a lattice. The construction of the ink cartridge 10*a* to 10*d* are same as those explained in the first embodiment.

Ink introducing tubes 121*a* to 121*d* are provided on the respective bottom surfaces of the cartridge holders 120*a* to 120*d* to protrude upwardly therefrom. In the cartridge holders 120*a* to 120*d*, the ink introducing tubes 121*a* to 121*d* are arranged so as to be concentrated in the inside of the ink cartridges 120*a* to 120*d*, as seen from the direction in which the ink cartridges 10*a* to 10*d* are mounted.

The cartridge holders 120*a* to 120*d* have slits 122*a* to 122*d* each of which is formed on a side surface of the cartridge holder. The slits 122*a* to 122*d* engage the projections 12*a* to 12*d* of the ink containers 11*a* to 11*d*, respectively. The slits 122*a* to 122*d* are arranged in a same position relative to the cartridge holders 120*a* to 120*d*, respectively, namely in a position off the center of the left side surface and toward the front side.

Further, as seen from the direction in which the ink cartridges 10*a* to 10*d* are mounted, the respective patterns of the positional relationship between the slits 122*a* to 122*d* of the cartridge holders 120*a* to 120*d* and the ink introducing tubes 121*a* to 121*d*, respectively, are different from each other.

As shown in FIG. 10, in the cartridge holder 120*a* corresponding to the black color, the slit 122*a* is arranged in a position off the center of the left side surface toward the front side. The ink introducing tube 121*a* is arranged in a position in the vicinity of the right side surface opposed to the left side surface where the slit 122*a* is arranged, and off the center of the cartridge holder 120*a* toward the front-right corner thereof. On the other hand, in the cartridge holder 120*b* corresponding to the cyan color, the slit 122*b* is arranged in a position off the center of the left side surface toward the front side. The ink introducing tube 121*b* is arranged in a position in the vicinity of the left side surface where the slit 122*b* is arranged, and off the center of the cartridge holder 120*b* toward the front-left corner thereof.

Similarly, in the cartridge holder 120*c* corresponding to the yellow color, the slit 122*c* is arranged in a position off the center of the left side surface toward the front side. The ink introducing tube 121*c* is arranged in a position in the vicinity of the left side surface where the slit 122*c* is arranged, and off the center of the cartridge holder 120*c* toward the rear-left corner thereof. On the other hand, in the cartridge holder 120*d* corresponding to the magenta color, the slit 122*d* is arranged in a position off the center of the left side surface to the front side. The ink introducing tube 121*d* is arranged in a position in the vicinity of the right side surface opposed to the left side surface where the slit 122*d* is arranged, and off the center of the cartridge holder 120*d* toward the rear-right corner thereof.

Thus, the respective patterns of positional relationship between the projections 12*a* to 121 and the insertion parts 16*a* to 16*d* of the ink cartridges 10*a* to 10*d*, and the respective patterns of positional relationship between the slits 122*a* to 122*d* of the cartridge holders 120*a* to 120*d* and the ink introducing tubes 121*a* to 121*d* are same per each of the colors of black, cyan, yellow and magenta.

As a result, when the ink cartridges 10*a* to 10*d* corresponding to the black, cyan, yellow and magenta colors respectively, are mounted on the respective corresponding cartridge holders 120*a* to 120*d*, as shown in FIG. 10, it is possible to engage the projections 12*a* to 12*d* with the slits 122*a* to 122*d*, respectively, and to enter the ink introducing tubes 121*a* to 121*d* into the insertion parts 16*a* to 16*d*, respectively.

As described above, in the ink jet printer of the second embodiment, it is also possible to prevent any one of the ink cartridges 10*a* to 10*d* from inadvertently being mounted on any one of the cartridge holders 120*a* to 120*d* to which the ink cartridge does not correspond to, as in the case of the first embodiment.

Since the cartridge holders 120*a* to 120*d* are arranged in the form of a lattice, it is possible to arrange the cartridge holders 120*a* to 120*d* in a compact manner.

Further, since the ink introducing tubes 121*a* to 122*d* are arranged so as to be concentrated in the inside of the cartridge holders 120*a* to 120*d*, it is possible to reduce the size of the part constructing the ink flow path in the printer 1.

Furthermore, since the slits 122*a* to 122*d* are arranged in a same position with respect to the cartridge holders 120*a* to 120*d*, respectively, it is possible to mount the ink cartridges 10*a* to 10*d* on the cartridge holders 120*a* to 120*d* while the projections 12*a* to 12*d* are oriented in a same direction.

Third Embodiment

With reference to FIGS. 11–17, an ink jet printer according to the third embodiment of the present invention is described below.

As described above, the ink cartridges 10*a*–10*d* for use in the ink jet printer 1 according to the first embodiment are substantially square in horizontal cross section. The ink jet printer according to the third embodiment differs from the ink jet printer 1 mainly in being for use with substantially cylindrical ink cartridges 210*a* to 210*d*. Accordingly, this ink jet printer has cartridge holders 220*a* to 220*d* are different in shape from the cartridge holders 20*a* to 20*d*. Otherwise the two ink jet printers are similar, and no detailed description is given of the ink jet printer according to this embodiment.

Figure 11:
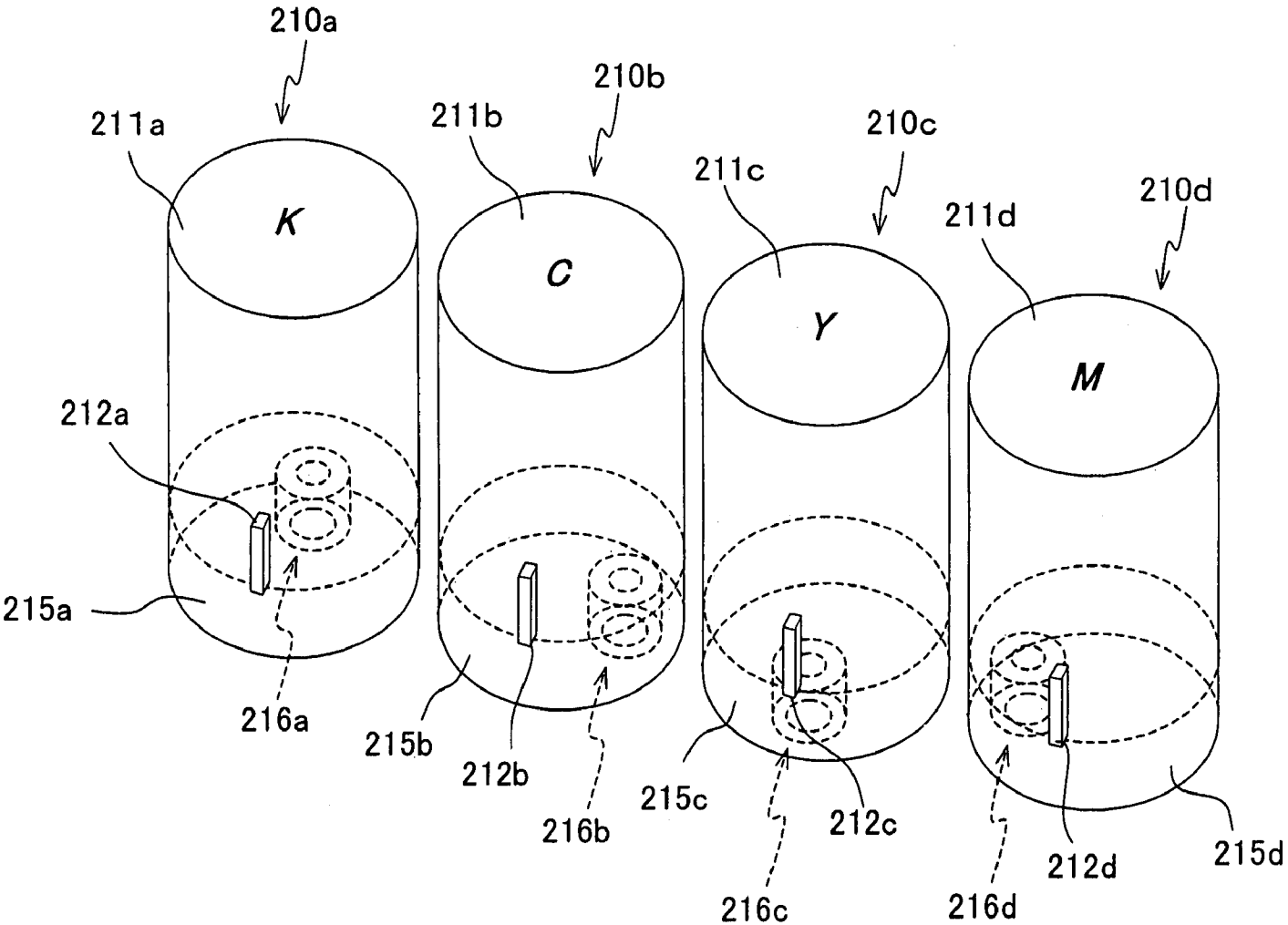
FIG. 11 is a perspective view of ink cartridges 210*a* to 210*d* for use in ink jet printers according to a third embodiment, a fourth embodiment and a fifth embodiment of the invention.
Figure 12:
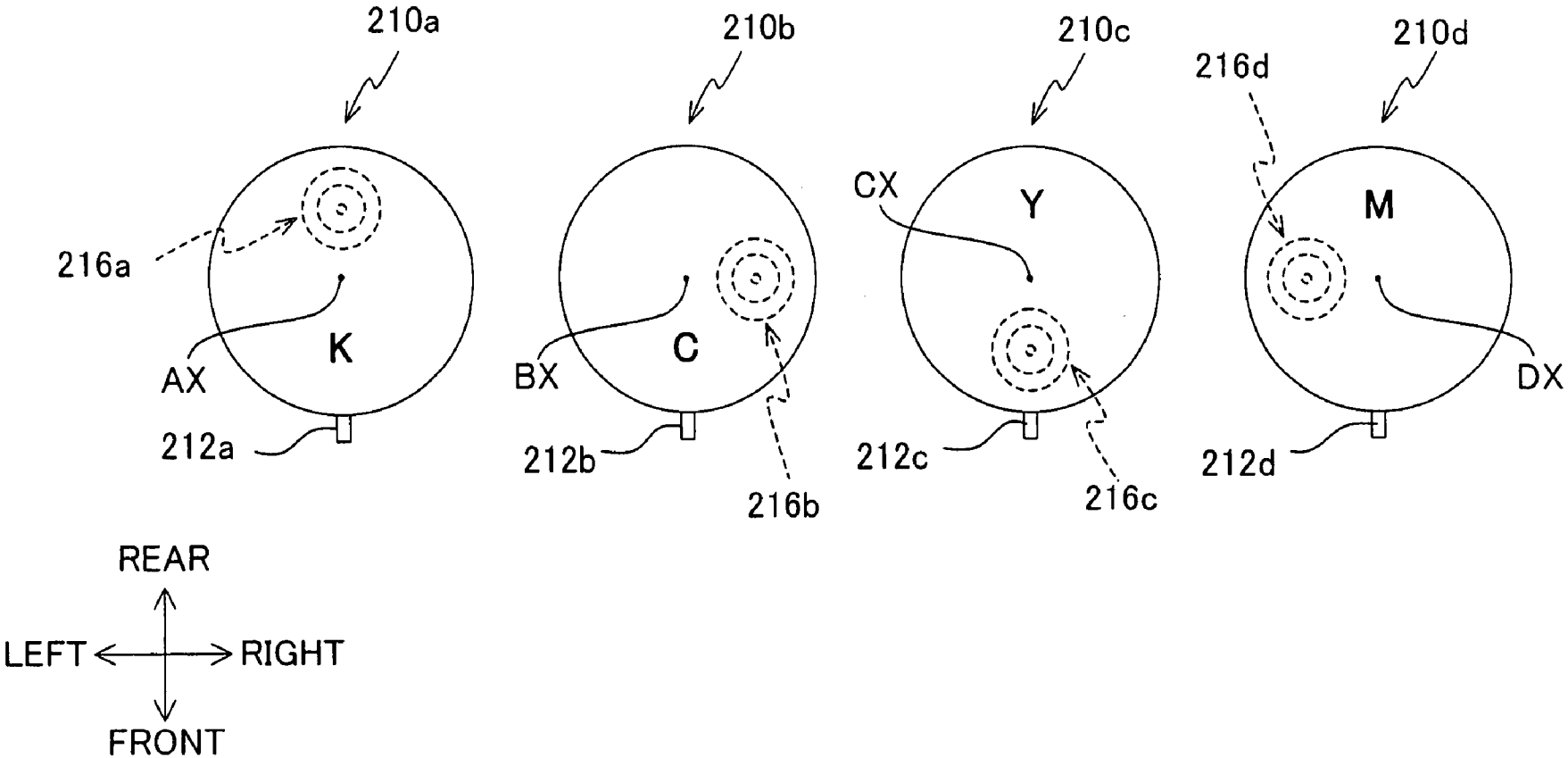
FIG. 12 is top view-of the ink cartridges 210*a* to 210*d;*
Figure 13A:
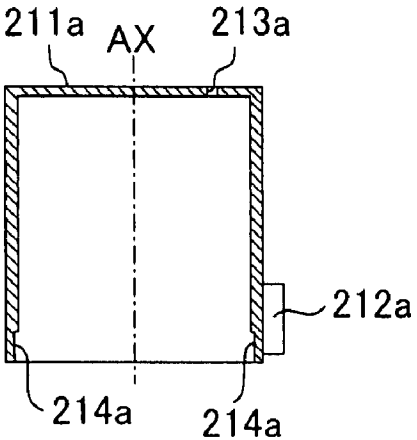
FIG. 13A is a vertical cross section of the ink container 211*a* of the black ink cartridge 210*a* shown in FIGS. 11 and 12.
Figure 13B:
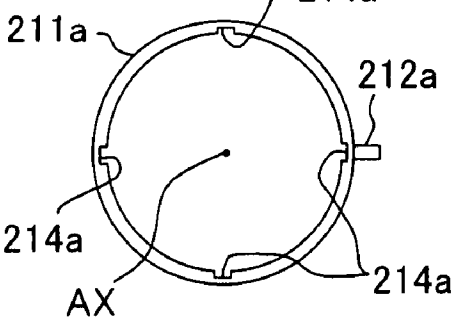
FIG. 13B is a bottom view of the ink container 211*a;*
Figure 13C:
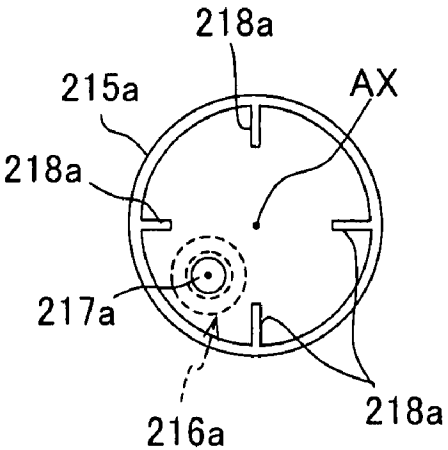
FIG. 13C is a top view of the lid 215*a* of the black ink cartridge 210*a* shown in FIGS. 11 and 12.
Figure 13D:
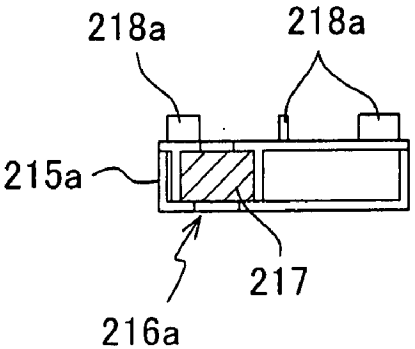
FIG. 13D is a vertical cross section of the lid 215*a;*
Figure 13E:
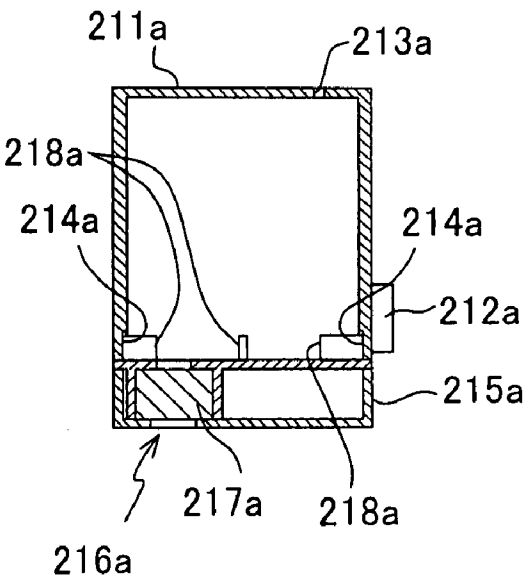
FIG. 13E is a vertical cross section of the black ink cartridge 210*a* shown in FIGS. 11 and 12.

With reference to FIGS. 11, 12 and 13A–13E, the structure of the ink cartridges 210*a* to 210*d* is described below in detail. FIGS. 11 and 12 are a perspective view and a top view respectively of ink cartridges 210*a* to 210*d*. FIGS. 13A to 13D schematically show the structure of the ink containers 211*a* and lid 215*a* of the black ink cartridge 210*a*. FIGS. 13A and 13B are a vertical cross section and a bottom view respectively of the ink container 211*a*. FIGS. 13C and 13D are a top view and a vertical cross section respectively of the lid 215*a*. FIG. 13E is a vertical cross section of the ink cartridge 210*a* in which the ink containers 211*a* and lid 215*a* are joined together.

The ink cartridge 210*a* consists of an ink container 211*a* and a lid 215*a* which are joined together. As shown in FIGS. 11, 13A, 13B and 13E, the ink container 211*a* is substantially cylindrical. One end of the ink container 211*a* is closed except for an air hole 213*a*, and the other end is open.

As shown in FIGS. 13A and 13B, the ink container 211*a* has four grooves (recesses) 214*a* cut inside its bottom (open end). The grooves 214*a* are positioned on two lines crossing at right angles at the axis of the ink container 211*a*. Accordingly, the bottom of the ink container 211*a* is thin at the grooves 214*a*.

The lid 215*a* closes an opening of the bottom of the ink container 211*a* and the projected configuration of the lid 215*a* is approximately same as that of the container 211*a*. As shown in FIGS. 13C and 13D, the lid 215*a* has four ribs 218*a* protruding upward from the top thereof (the surface joined to the container 211*a*) in the vicinity of the outer periphery of the lid 215*a*. The ribs 218*a* are positioned on two lines crossing at right angles at the axis of the lid 215*a*. The outer end of each rib 218*a* is spaced inward from the outer edge of the lid 215*a* by a predetermined distance, which is nearly equal to the distance between the outer cylindrical surface of the ink container 211*a* and the bottom of each container groove 214*a*.

The four grooves 214*a* of the ink container 211*a* are substantially same in width and height to the outer ends of the ribs 218*a* of the lid 215*a*. Accordingly, when the lid 215*a* is joined to the ink container 211*a*, the outer ends of the ribs 218*a* can engage with the grooves 214*a*. The four grooves

214*a* and the outer ends of the four ribs 218*a* are same in shape and positioned at angularly regular intervals in rotation symmetry with the axis AX. Accordingly, when the lid 215*a* is joined to the ink container 211*a*, the lid 215*a* can be in any one of four joining postures by being turned by 90 degrees about the axis AX at a time.

FIG. 13E shows the black ink cartridge 210*a* formed by joining the lid 215*a* in one of the four postures relative to the ink container 211*a*.

The ink containers 211*a*–211*d* of the black, cyanic, yellow and magenta ink cartridges 210*a*–210*d* are same in structure. The lids 215*a*–215*d* of the ink cartridges 210*a*–210*d* are same in structure. Each of the lids 215*a*–215*d* of the ink cartridges 210*a*–210*d* is joined in a different posture to the associated ink container 211*a*, 211*b*, 211*c* or 211*d*.

FIG. 12 is a top view of the ink cartridges 210*a* to 210*d* produced by joining the lids 215*a* to 215*d* in the four postures to the ink containers 211*a*–211*d* respectively. In FIG. 12, front/near and left/right directions are indicated by arrows for explanation of configuration of the cartridges 120*a* to 120*d*.

As shown in FIG. 12, the projection 212*a* of the black ink cartridge 210*a* is arranged at the front side, and the insertion part 216*a* is arranged off the axis AX of the ink cartridge 210*a* toward the rear side opposite to the front side where the projection 212*a* is arranged. Likewise, the projection 212*b* of the cyan ink cartridge 210*b* is arranged at the front side, and the insertion part 216*b* is arranged off the axis BX of the ink cartridge 210*b* toward the right side.

Likewise, the projection 212*c* of the yellow ink cartridge 210*c* is arranged at the front side, and the insertion part 216*c* is arranged off the axis CX of the ink cartridge 210*c* toward the front side where the projection 212*c* is positioned. Likewise, the projection 212*d* of the magenta ink cartridge 210*d* is arranged at the front end, and the insertion part 216*d* is arranged off the axis DX of the ink cartridge 210*d* toward the left side.

As shown in FIG. 12, each of the insertion parts 216*a* to 216*d* is positioned eccentric from (positioned off) the axes AX, BX, CX or DX of the ink cartridge 210*a*, 210*b*, 210*c* or 210*d*.

FIG. 12 shows the black, cyan, yellow and magenta ink cartridges 210*a* to 210*d* in that order from the left side to the right side. Each of the projections 212*a* to 212*d* is arranged differently relative to the associated insertion part 216*a*, 216*b*, 216*c* or 216*d*. In other words, the projections 212*a*, 212*b*, 212*c* or 212*d* and insertion parts 216*a*, 216*b*, 216*c* or 216*d* of each of the ink cartridges 210*a* to 210*d* have a different pattern of the positional relationship therebetween as seen in the direction in which the cartridge is mounted.

Figure 14:
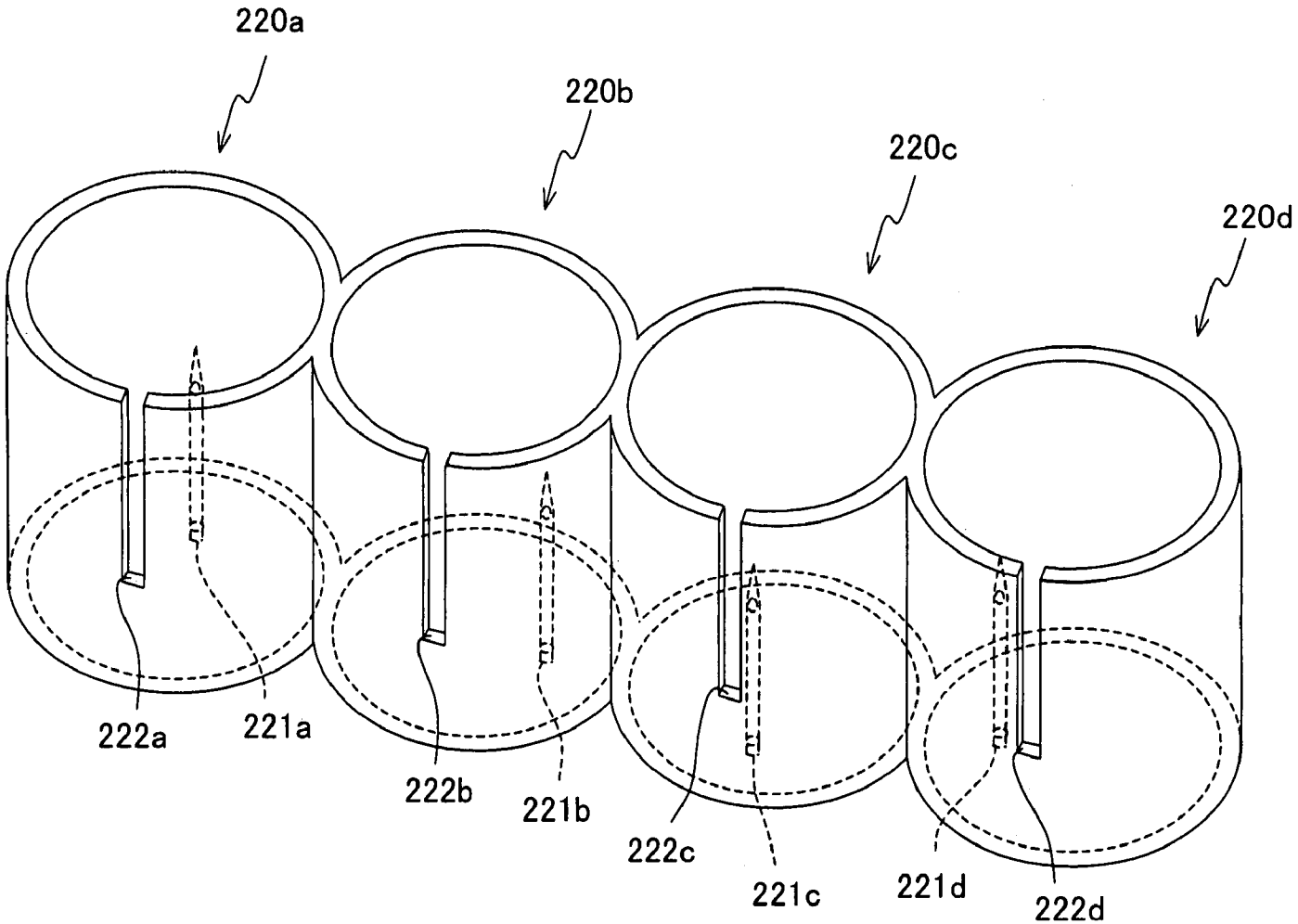
FIG. 14 is a perspective view of the cartridge holders 220*a* to 220*d* of the printer according to the third embodiment.
Figure 15:
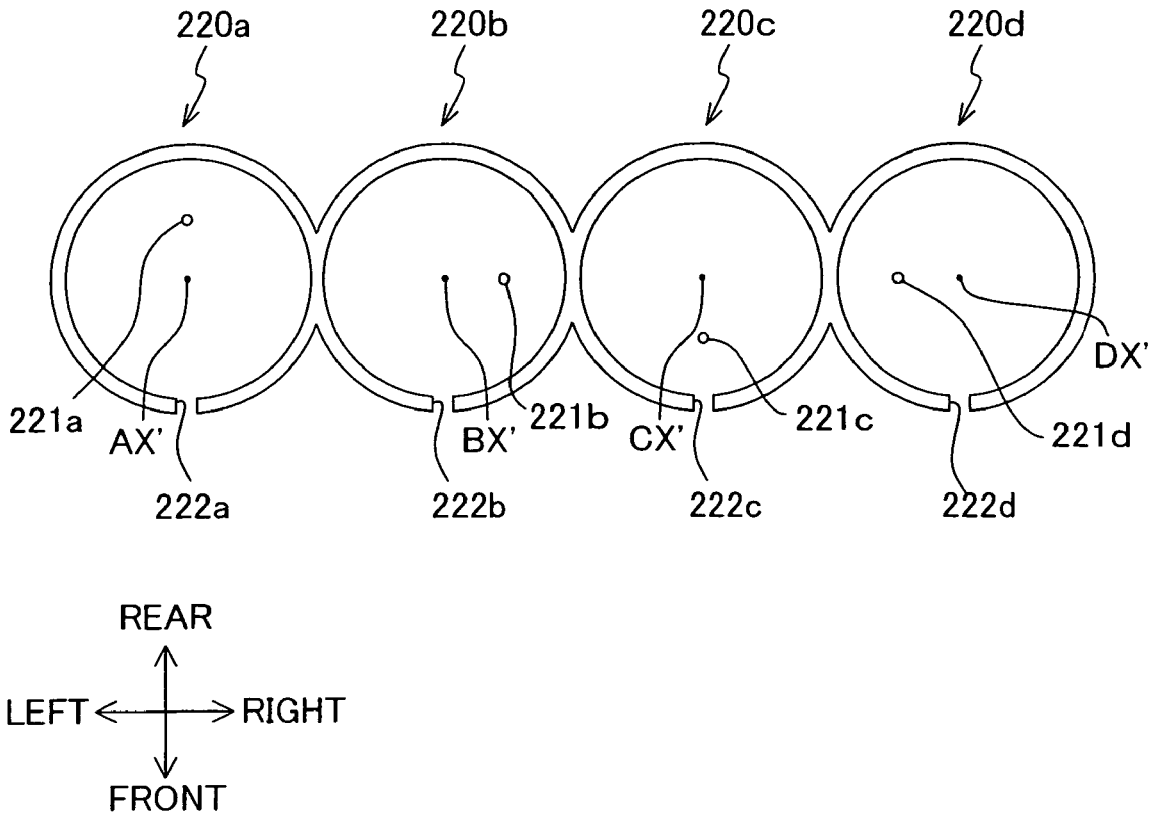
FIG. 15 is a top view of the cartridge holders 220*a* to 220*d;*
Figure 16:
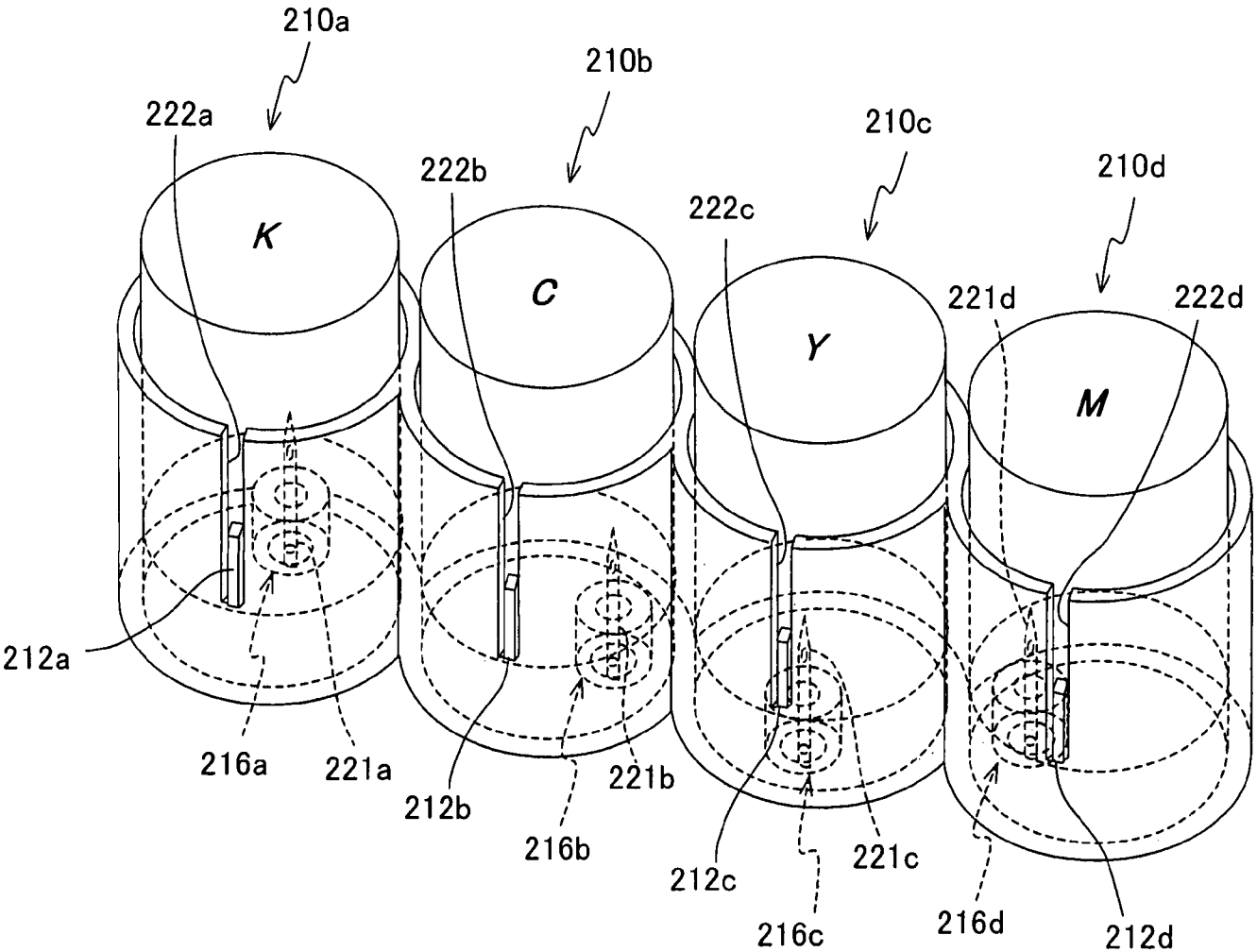
FIG. 16 is a perspective view of the cartridge holders 220*a* to 220*d* with the ink cartridges 210*a* to 210*d* mounted thereon.
Figure 17:
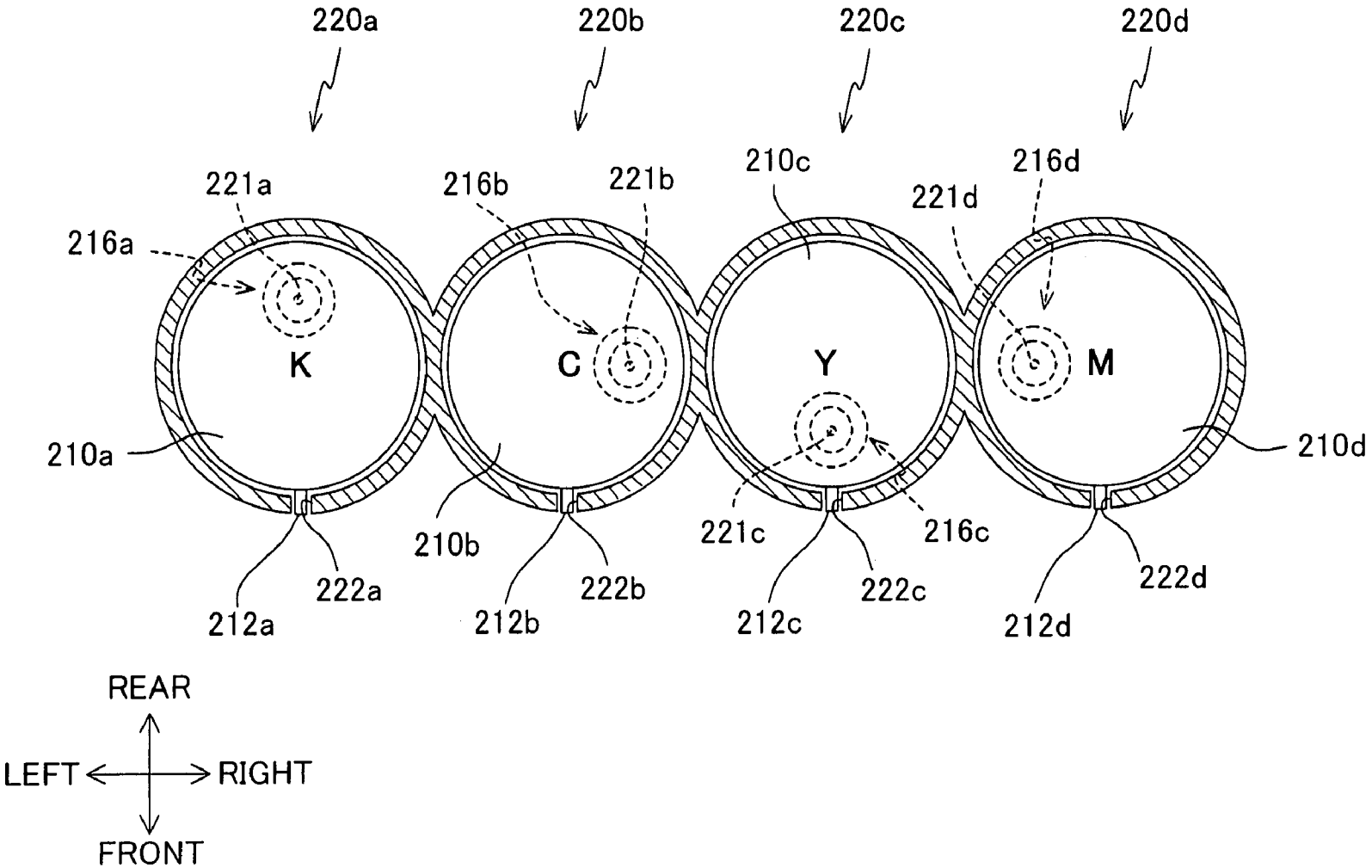
FIG. 17 is a top view of the cartridge holders 220*a* to 220*d* with the ink cartridges 210*a* to 210*d* mounted thereon.

With reference to FIGS. 14 and 15, the structure of the cartridge holders 220*a*–220*d* is described below in detail. FIGS. 14 and 15 are a perspective view and a top view respectively of the cartridge holders 220*a* to 220*d*. FIGS. 16 and 17 are a perspective view and a top view respectively of the cartridge holders 220*a* to 220*d* with the ink cartridges 210*a* to 210*d* mounted thereon. In FIG. 15, front/near and left/right directions are indicated by arrows for explanation of configuration of the cartridge holders 220*a* to 220*d*. In FIG. 17, the upper/lower and left/right directions corresponding to the view of FIG. 15 are shown by arrows for explanation of the configuration of the cartridge holders 220*a* to 220*d*.

As shown in FIG. 14, the cartridge holders 220*a* to 220*d* have a substantially cylindrical shaped member on which the ink cartridges 210*a* to 210*d* are mounted respectively. The cartridge holders 220*a* to 220*d* are arranged in a line. The internal spaces of the cartridge holders 220*a* to 220*d* are approximately equal to the horizontally sectional area of the ink cartridges 210*a* to 210*d*. The cartridge holders 220*a* to 220*d* are an integrally formed as like a molded member.

Ink introducing tubes 221*a* to 221*d* are provided on the bottom surface of the cartridge holders 220*a* to 220*d* respectively to protrude upwardly therefrom. Each of the ink introducing tubes 221*a* to 221*d* is eccentric from (positioned off) each of the axes AX', BX', CX' or DX' of the cartridge holder 220*a*, 220*b*, 220*c* or 220*d*. The tip of each of the introducing tubes 221*a*–221*d* is positioned at nearly equal distances from the top and the bottom of the cartridge holder 220*a*, 220*b*, 220*c* or 220*d*.

The cartridge holders 220*a* to 220*d* have slits 222*a* to 222*d* cut in their respective cylindrical side walls with which the projections 212*a* to 212*d* of the ink containers 211*a* to 211*d* are engaged. Each of the slits 222*a* to 222*d* extends downwardly from the top of the cartridge holder 220*a*, 220*b*, 220*c* or 220*d* toward the middle of the holder in the height thereof. The slits 222*a* to 222*d* are formed in the same position (at the front side in FIG. 15) in the cartridge holders 220*a* to 220*d* respectively.

As shown in FIG. 15, the slit 222*a* of the cartridge holder 220*a* for the black ink cartridge is arranged at the front side, and the ink introducing tube 221*a* is arranged eccentric from the axis AX' toward the rear side. Likewise, the slit 222*b* of the cartridge holder 220*b* for the cyan ink cartridge is arranged at the front side, and the ink introducing tube 221*b* is arranged eccentric from the axis BX' toward the right side.

Likewise, the slit 222*c* of the cartridge holder 220*c* for the yellow ink cartridge is arranged at the front side, and the ink introducing tube 221*c* is arranged eccentric from the axis CX' toward the front side. Likewise, the slit 222*d* of the cartridge holder 220*d* for the magenta ink cartridge is arranged at the front side, and the ink introducing tube 221*d* is arranged eccentric from the axis DX' toward the left side.

FIG. 15 shows the cartridge holders 220*a* to 220*d* for the black, cyan, yellow and magenta ink cartridges 210*a* to 210*d* respectively in this order from the left side from the right side. Each of the slits 222*a* to 222*d* is arranged differently relative to the associated introducing tube 221*a*, 221*b*, 221*c* or 221*d*. In other words, the slit 222*a*, 222*b*, 222*c* or 222*d* of each of the cartridge holders 220*a* to 220*d* and introducing tube 221*a*, 221*b*, 221*c* or 221*d* have a different pattern of positional relationship therebetween as seen in the direction in which the associated ink cartridge 210*a*, 210*b*, 210*c* or 210*d* is mounted.

As understood from the foregoing description, the pattern of positional relationship between the projection 212*a*, 212*b*, 212*c* or 212*d* and insertion part 216*a*, 216*b*, 216*c* or 216*d* of each of the black, cyan, yellow and magenta ink cartridges 210*a* to 210*d* is same as that of the slit 222*a*, 222*b*, 222*c* or 222*d* of the associated cartridge holder 220*a*, 220*b*, 220*c* or 220*d* and ink introducing tube 221*a*, 221*b*, 221*c* or 221*d*. Accordingly, as shown in FIGS. 16 and 17, the ink cartridges 210*a* to 210*d* can be appropriately mounted in the proper cartridge holders 220*a* to 220*d* respectively without misfit by the user.

Thus, as is the case with the first embodiment, it is possible to prevent any one of the ink cartridges 210*a* to 210*d* from being mounted by mistake in any one of the cartridge holders 220*a* to 220*d* to which the ink cartridge does not correspond. Because the identical ink containers 211*a* to 211*d* and identical lids 215*a* to 215*d* can be used in common for all ink cartridges 210*a* to 210*d*, the cartridges can be produced at low cost.

Because the cartridge holders 220*a* to 220*d* are arranged in a line, it is possible to reduce the width of a section in the printer in which the cartridge holders 220*a* to 220*d* are provided.

Because the ink containers 211*a* to 211*d* and lids 215*a* to 215*d* are circular in cross section, it is possible to determine any number of postures in which the lids can be joined to the containers. In other words, by setting any turning angle of each of the lids 215*a* to 215*d* relative to one of the ink containers 211*a* to 211*d* when joining the lid to the container, it is possible to determine a number of joining postures without using special structure or member. Accordingly, it is possible to assemble even more than four ink cartridges for different colors from one type of ink container and one type of lid.

Because the slits 222*a* to 222*d* are arranged in the same position relative to the cartridge holders 220*a* to 220*d* respectively, it is possible to mount the ink cartridges in the cartridge holders, with the projections 212*a* to 212*d* oriented in the same direction.

In this embodiment, the lid 215*a* is joined to the ink container 211*a*, with the four ribs 218*a* engaging with the four grooves 214*a*. Thus, the grooves 214*a* and ribs 218*a* determine four postures in any one of which the lid 215*a* can be joined to the ink container 211*a*. However, any arbitrary joining structure may be adopted in which the lid 215*a* can be joined to the ink container 211*a* by any joints other than grooves and ribs. For example, the cylindrical circumference of the top of the lid 215*a* may be extended upwardly to have a ring-shaped form for engaging with the bottom of the ink container 211*a*. In this case, the top of the lid 215*a* and the bottom of the ink container 211*a* would be joining parts, and the rotational angles (90 degrees each) about the axis AX at which the lid 215*a* can be joined in four postures to the ink container 211*a* make it possible to assemble four different ink cartridges. It is preferable that marks be put on the ink container 211*a* and lid 215*a* to easily distinguish their joining orientations.

Forth Embodiment

Figure 18:
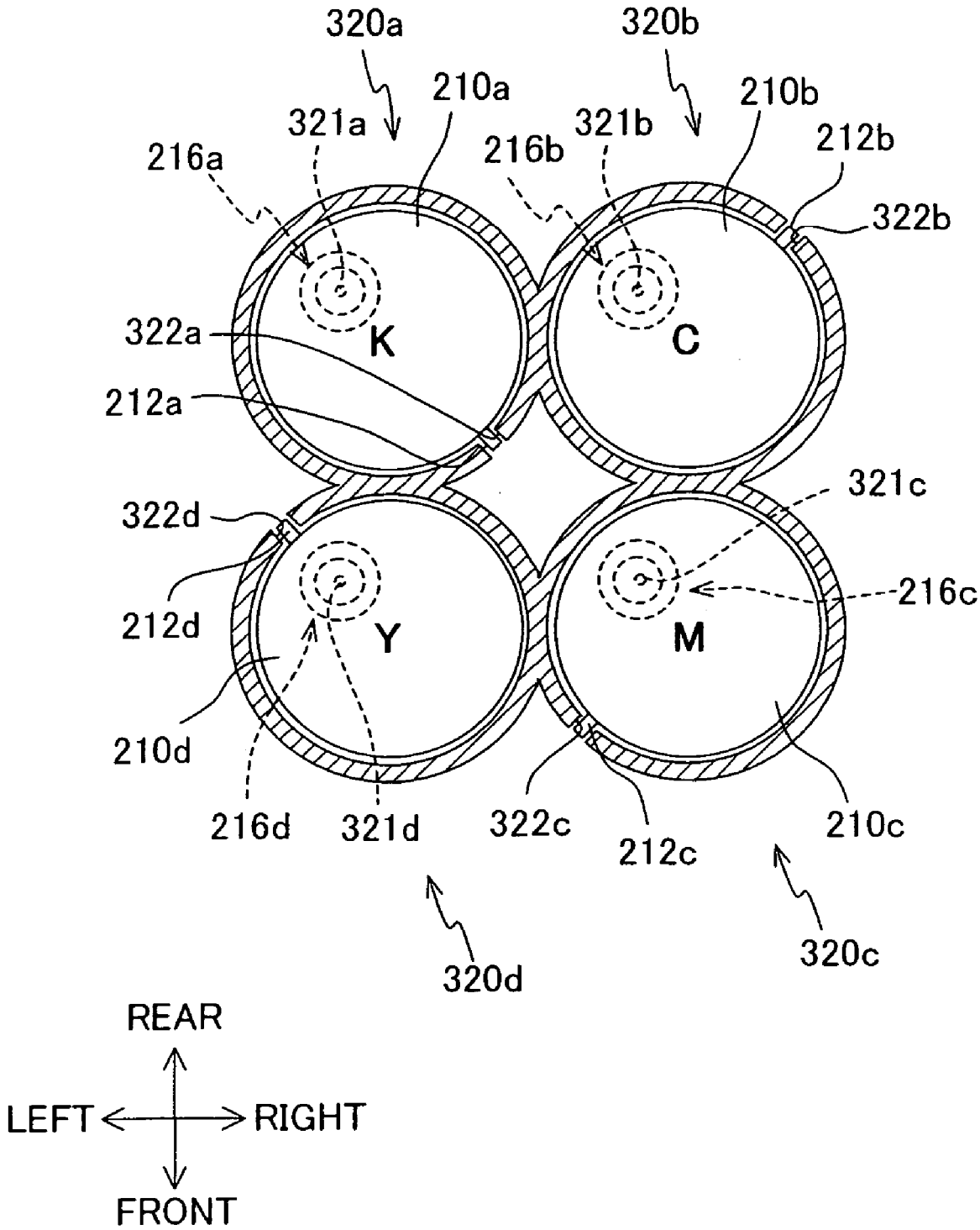
FIG. 18 is a top view of the cartridge holders 320*a* to 320*d* of the printer according to the fourth embodiment with the ink cartridges 210*a* to 210*d* mounted on the cartridge holders.

With reference to FIG. 18, an ink jet printer according to a fourth embodiment of the present invention is described below. FIG. 18 is a top view of the cartridge holders 320*a* to 320*d* of the printer according to this embodiment with the ink cartridges 210*a* to 210*d* mounted thereon. In FIG. 18, front/near and left/right directions are indicated by arrows for explanation of configuration of the cartridges 320*a* to 320*d*.

As described above, the cartridge holders 220*a* to 220*d* of the printer according to the third embodiment are arranged in a line. The ink jet printer according to the fourth embodiment differs from that according to the third embodiment mainly in that the cartridge holders 320*a* to 320*d* are arranged in the form of a lattice. Otherwise the two ink jet printers are similar, and no detailed description is given of the ink jet printer according to this embodiment.

The cartridge holders 320*a* to 320*d* have a substantially cylindrical-shaped member on which black, cyan, yellow and magenta ink cartridges 210*a* to 210*d* are mounted respectively. As shown in FIG. 18, the cartridge holders 320*a* to 320*d* are arranged in the form of a lattice. The structure of the ink cartridges 210*a* to 210*d* is as described for the third embodiment.

Ink introducing tubes 321*a* to 321*d* are provided in the bottoms of the cartridge holders 320*a* to 320*d* respectively to protrude upwardly therefrom. The cartridge holders 320*a* to 320*d* have slits 322*a* to 322*d* cut in their respective cylindrical walls with which the projections 212*a* to 212*d* of the ink containers 211*a* to 211*d* are engaged.

The slit 322*a*, 322*b*, 322*c* or 322*d* of each of the cartridge holders 320*a* to 320*d* and the introducing tube 321*a*, 321*b*, 321*c* or 321*d* have a different pattern of the positional relationship therebetween as seen in the direction in which the associated ink cartridge 210*a*, 210*b*, 210*c* or 210*d* is mounted. The introducing tubes 321*a* to 321*d* are arranged in the same position relative to the cartridge holders 320*a* to 320*d* respectively. Specifically, each of the introducing tubes 321*a* to 321*d* is arranged off the center toward the rear-left side of the associated cartridge holder 320*a*, 320*b*, 320*c* or 320*d* in FIG. 18.

Thus, as is the case with the third embodiment, it is possible to prevent any one of the ink cartridges 210*a* to 210*d* from being mounted by mistake in any one of cartridge holders 320*a* to 320*d* to which the ink cartridge does not correspond.

Because the cartridge holders 320*a* to 320*d* are arranged in the form of a lattice, it is possible to arrange the holders in a compact manner.

Because the ink introducing tubes 321*a* to 321*d* are arranged in the same position relative to the cartridge holders 320*a* to 320*d* respectively, it is possible to mount the ink cartridges 210*a* to 210*d* on the cartridge holders 320*a*–320*d* respectively, with the ink insertion parts 216*a* to 216*d* oriented in the same direction.

Fifth Embodiment

Figure 19:
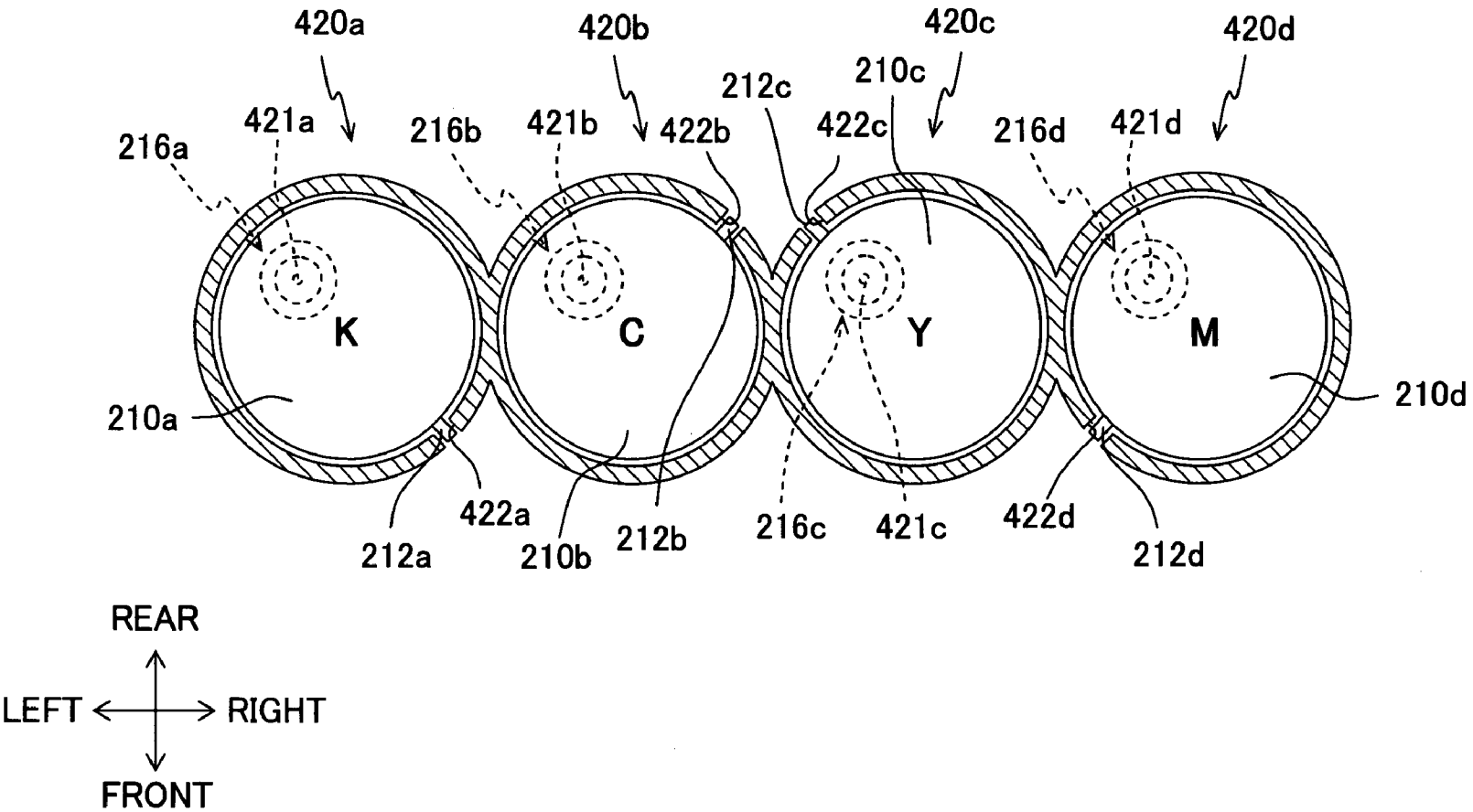
FIG. 19 is a top view of the cartridge holders 420*a* to 420*d* of the printer according to the fifth embodiment with the ink cartridges 210*a* to 210*d* mounted on the cartridge holders.

With reference to FIG. 19, an ink jet printer according to a fifth embodiment of the present invention is described below. FIG. 19 shows the cartridge holders 420*a* to 420*d* of the printer with the ink cartridges 210*a* to 210*d* mounted thereon. In FIG. 19, front/near and left/right directions are indicated by arrows for explanation of configuration of the cartridges 420*a* to 420*d*.

As described above, the ink introducing tubes 221*a* to 221*d* of the ink jet printer according to the third embodiment are arranged differently relative to the cartridge holders 220*a* to 220*d* respectively. The ink jet printer according to the fifth embodiment differs from that according to the third embodiment mainly in that the cartridge holders 420*a* to 420*d* have ink introducing tubes 421*a* to 421*d* each of which is arranged in the same position relative to the associated holder. Otherwise the two ink jet printers are similar, and no detailed description is given of the ink jet printer according to the fifth embodiment.

The cartridge holders 420*a* to 420*d* have a substantially cylindrical-shaped member on which black, cyan, yellow and magenta ink cartridges 210*a* to 210*d* are mounted respectively. As shown in FIG. 19, the cartridge holders 420*a* to 420*d* are arranged in a line. The structure of the ink cartridges 210*a* to 210*d* is as described for the third embodiment.

Ink introducing tubes 421*a* to 421*d* are provided in the bottoms of the cartridge holders 420*a* to 420*d* respectively to protrude upwardly therefrom. The cartridge holders 420*a* to 420*d* have slits 422*a* to 422*d* cut in their respective side cylindrical walls with which the projections 212*a* to 212*d* of the ink containers 211*a* to 211*d* are engaged.

The slit 422*a*, 422*b*, 422*c* or 422*d* of each of the cartridge holders 420*a* to 420*d* and the introducing tube 421*a*, 421*b*, 421*c* or 421*d* have a different pattern of the positional relationship therebetween as seen in the direction in which the associated ink cartridge 210*a*, 210*b*, 210*c* or 210*d* is mounted. The ink introducing tubes 421*a* to 421*d* are arranged in the same position relative to the cartridge holders 420*a* to 420*d* respectively. Specifically, each of the ink introducing tubes 421*a* to 421*d* is arranged off the center toward the rear-left side of the associated cartridge holder 420*a*, 420*b*, 420*c* or 420*d* in FIG. 19.

Thus, as is the case with the third embodiment, it is possible to prevent any one of the ink cartridges 210*a* to 210*d* from being mounted by mistake in any one of cartridge holders 420*a* to 420*d* to which the ink cartridge does not correspond.

Because the cartridge holders 420*a* to 420*d* are arranged in a line, it is possible to reduce the width of a section in the printer where the holders are provided.

Because the ink introducing tubes 421*a* to 421*d* are arranged in the same position relative to the cartridge holders 420*a* to 420*d* respectively, it is possible to mount the ink cartridges 210*a* to 210*d* in the cartridge holders 420*a* to 420*d* respectively, with the ink insertion parts 216*a* to 216*d* oriented in the same direction.

Sixth Embodiment

Figure 20A:
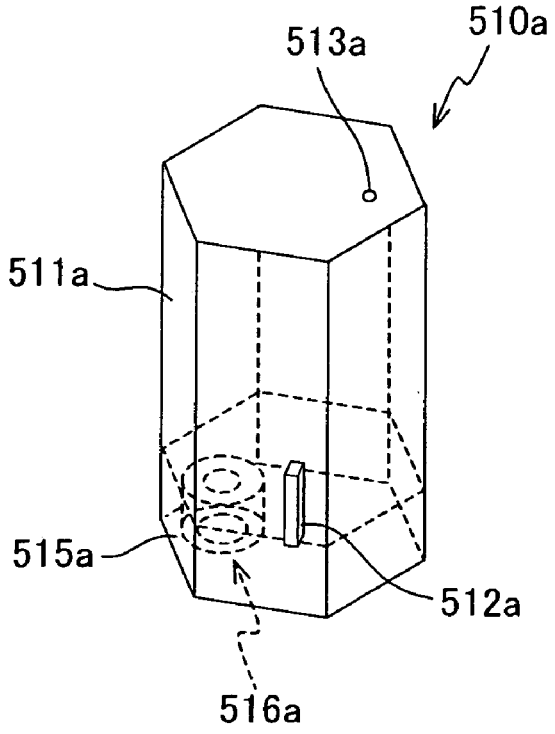
FIG. 20A is a perspective view of an ink cartridge 510*a* for use in an ink jet printer according to a sixth embodiment of the invention.
Figure 20B:
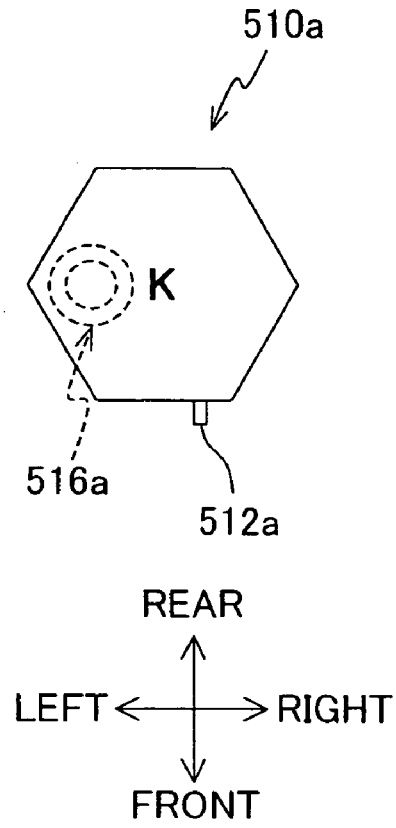
FIG. 20B is a top view of the ink cartridge 510*a;*
Figure 21:
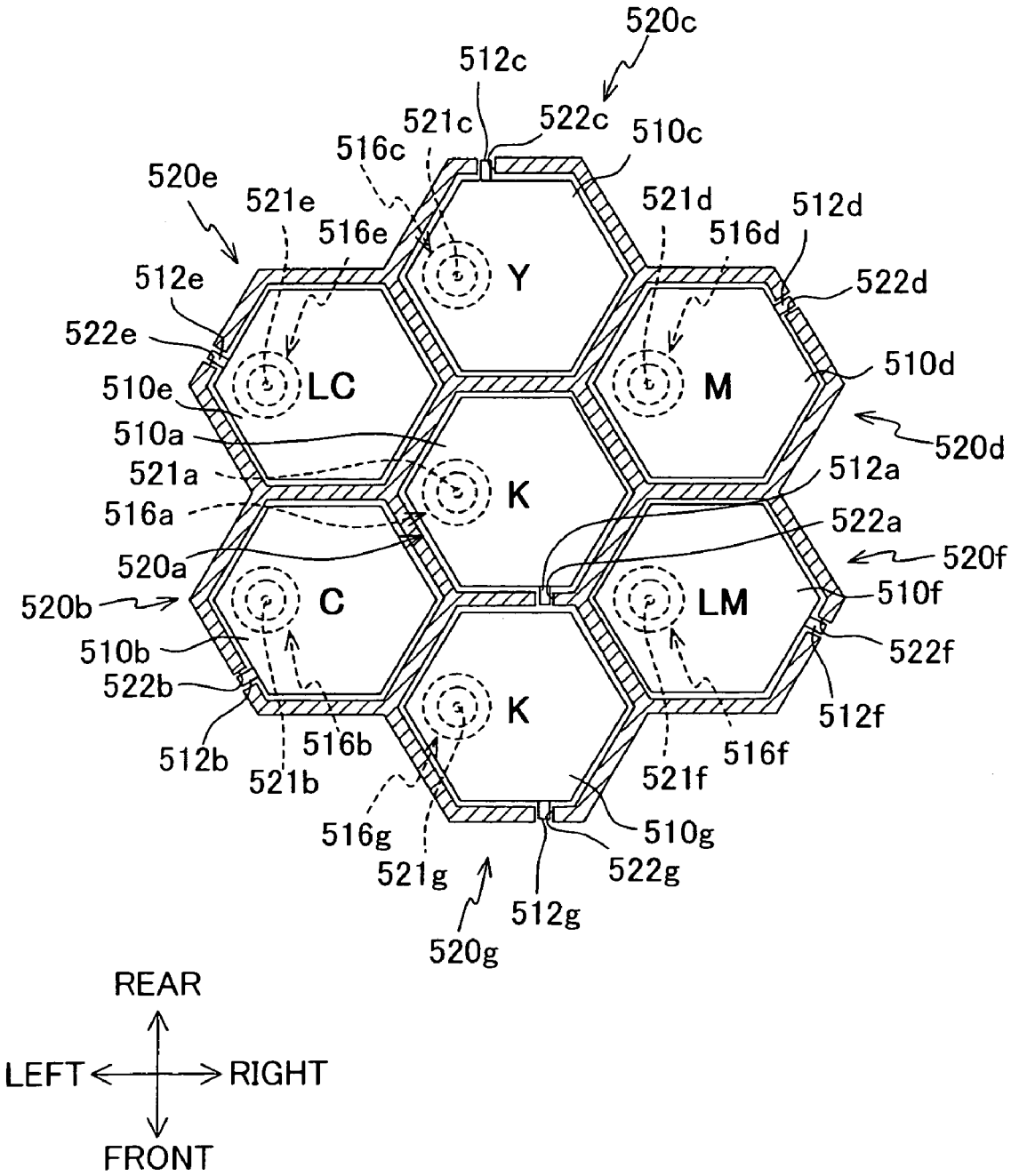
FIG. 21 is a top view of the cartridge holders 520*a* to 520*g* of the printer according to the sixth embodiment with the ink cartridges 510*a* to 510*g* mounted on the cartridge holders.

With reference to FIGS. 20A, 20B and 21, an ink jet printer according to a sixth embodiment of the present invention is described below. In FIG. 20B, front/near and left/right directions are indicated by arrows for explanation of configuration of the cartridge 510*a*.

As described above, the ink jet printer 1 according to the first embodiment is for use with four ink cartridges 10*a* to 10*d* square in horizontal cross section. The ink jet printer according to the sixth embodiment differs from the ink jet printer 1 mainly in being for use with seven ink cartridges 510*a* to 510*g* hexagonal in horizontal cross section. The two ink cartridges 510*a* and 210*g* are black ink cartridges, which are ink cartridges of high consumption. This ink jet printer has cartridge holders 520*a* to 520*g* different in shape from the cartridge holders 20*a* to 20*d*. Otherwise the two ink jet printers are similar, and no detailed description is given of the ink jet printer according to the sixth embodiment.

With reference to FIGS. 20A and 20B, the structure of the ink cartridges 510*a* to 510*g* is described below in detail. FIGS. 20A and 20B are a perspective view and a top view respectively of the ink cartridge 510*a*. The ink cartridges 510*a* to 510*g* are filled with black, cyan, yellow, magenta, light cyan, light magenta and black inks respectively. Only the black ink cartridge 510*a* is described below in detail.

The ink cartridge 510*a* consists of an ink container 511*a* and a lid 515*a* which are joined together. The ink container 511*a* is a tubular member which is hexagonal in horizontal cross section. The ink container 511*a* is closed at one end thereof except for an air hole 513*a*, and is open at the other end.

The ink container 511*a* has six grooves (not shown) cut inside bottom thereof (open end) each of the six grooves is arranged in the middle of one of the six sides of the bottom. The lid 515*a* closes an opening of the bottom of the ink container 511*a*. The top (surface joined to the container 511*a*) of the lid 515*a* has six ribs (not shown) formed near the outer periphery thereof, each of which is provided in the middle of one of the six sides of the top to protrude upwardly therefrom. The six grooves of the ink container 511*a* and the six ribs of the lid 515*a* are similar in structure to the four recesses 14*a* of the ink container 11*a* and the ribs 18*a* of the lid 15*a* respectively of the first embodiment. Accordingly, it is possible to join the lid 515*a* in any one of six joining postures to the ink container 511*a* by turning the lid 515*a* by 60 degrees at a time.

The ink containers of the black, cyan, yellow, magenta, light cyan, light magenta and black ink cartridges 510*a* to 510*g* are same in structure. The lids of the ink cartridges 510*a* to 510*g* are same in structure. Each of the ink containers of the ink cartridges 510*a* to 510*f* is joined in a different posture to the associated ink container. Each of the ink containers of the same type ink cartridges 510*a* and 510*g* is joined in the same posture to the associated ink container.

FIG. 21 is a top view of the cartridge holders 520*a* to 520*g* of the ink jet printer according to this embodiment with the ink cartridges 510*a* and 510*g* mounted thereon. In FIG. 21, front/near and left/right directions are indicated by arrows for explanation of configuration of the cartridges 520*a* to 520*g*. As seen from FIG. 21, the ink cartridges 510*a* and 510*g* have insertion parts 516 to 516*g* respectively each of which is arranged off the center of the associated cartridge.

The cartridge holders 520*a* to 520*g* have a member which is substantially hexagonal in horizontal cross section and on which the ink cartridges 510*a* and 510*g* can be mounted respectively. The internal spaces of the cartridge holders 520*a* to 520*g* are nearly equal in horizontally sectional area to the ink cartridges 510*a* to 510*g*.

Ink introducing tubes 521*a* to 521*g* are provided in the bottoms of the cartridge holders 520*a* to 520*g* respectively to protrude upwardly therefrom. Each of the introducing tubes 521*a* to 521*g* is eccentric from (positioned off) the center of the associated cartridge holder 520*a*, 520*b*, 520*c*, 520*d*, 520*e*, 520*f* or 520*g*. The ink introducing tubes 521*a* to 521*g* are arranged in the same position near the left side (corner) of the cartridge holders 520*a* to 520*g* respectively. The cartridge holders 520*a* to 520*g* have slits 522*a* to 522*g* respectively cut in peripheral walls thereof with which the projections 512*a* to 512*g* of the ink containers 511*a* to 511*g* are respectively engaged.

As shown in FIG. 21, the projection 512*a*, 512*b*, 512*c*, 512*d*, 512*e* or 512*f* and insertion part 516*a*, 516*b*, 516*c*, 516*d*, 516*e* or 516*f* of each of the black, cyan, yellow, magenta, light cyan and light magenta ink cartridges 510*a* to 510*f* have a different pattern of the positional relationship therebetween as seen in the direction on which the cartridge is mounted. The slit 522*a*, 522*b*, 522*c*, 522*d*, 522*e* or 522*f* of each of the cartridge holders 520*a* to 520*f* and the introducing tube 521*a*, 521*b*, 521*c*, 521*d*, 521*e* or 521*f* of have a different pattern of the positional relationship therebetween as seen in the direction on which the associated ink cartridge 510*a*, 510*b*, 510*c*, 510*d*, 510*e* or 510*f* is mounted.

As understood from the foregoing description, the pattern of the positional relationship between the projection 512*a*, 512*b*, 512*c*, 512*d*, 512*e* or 512*f* and the insertion part 516*a*, 516*b*, 516*c*, 516*d*, 516*e* or 516*f* of each of the black, cyan, yellow, magenta, light cyan and light magenta ink cartridges 510*a* to 510*f* is same as that of the slit 522*a*, 522*b*, 522*c*, 522*d*, 522*e* or 522*f* and the ink introducing tube 521*a*, 521*b*, 521*c*, 521*d*, 521*e* or 521*f* of the associated cartridge holder 520*a*, 520*b*, 520*c*, 520*d*, 520*e* or 520*f*. Accordingly, the ink cartridges 510*a* to 510*f* can be appropriately mounted in the proper cartridge holders 520*a* to 520*f* respectively without any misfit by the user.

The pattern of the positional relationship between the projection 512*a* and insertion part 516*a* of the ink cartridge 510*a* is same as that of the projection 512*g* and insertion part 516*g* of the ink cartridge 510*g*. The pattern of the positional relationship between the slit 522*a* and ink introducing tube 521*a* of the cartridge holder 520*a* is same as that of the slit

522*g* and ink introducing tube 521*g* of the cartridge holder 520*g*. Accordingly, each of the ink cartridges 510*a* and 510*g* can be mounted in either of the cartridge holders 520*a* and 520*g*.

Thus, as is the case with the first embodiment, it is possible to prevent any one of the ink cartridges 510*a* to 510*g* from being mounted by mistake in any one of the cartridge holders 520*a* to 520*g* to which the ink cartridge does not correspond. Because the identical ink containers 511*a* to 511*g* and identical lids 215*a* to 215*g* can be used in common for all ink cartridges 510*a* to 510*g*, six types of ink cartridges 510*a* to 510*f* can be produced from one type of ink container and one type of lid, so that the cartridges can be produced at low cost.

Because the ink introducing tubes 521*a* to 521*g* are arranged in the same position relative to the cartridge holders 520*a* to 520*g* respectively, it is possible to mount the ink cartridges 510*a* to 510*g* in the cartridge holders 520*a* to 520*g* respectively, with the insertion parts 516*a* to 516*g* oriented in the same direction.

Because the ink containers 511*a* to 511*g* and lids 515*a* to 515*g* are hexagonal in horizontal cross section, it is easy to determine different joining postures in which they can be joined together. The number of postures in which the lids 515*a* to 515*g* can be joined to the ink containers 511*a* to 511*g* equals the number of sides of a hexagon. Accordingly, it is possible to determine different joining postures without using special structure or member. In this embodiment, the six grooves and the six ribs determine six postures in which the lids 515*a* to 515*g* can be joined to the ink containers 511*a* to 511*g*. However, any arbitrary joining construction may be adopted in which the lids 515*a* to 515*g* can be joined to the ink containers 511*a* to 511*g* by any means other than grooves and ribs.

The preferred embodiments of the present invention have been described hereinbefore, but the present invention is not limited thereto. The invention may be modified into various forms within the scope of the appended claims. For example, in each of the embodiments, the cartridge holders are arranged in a line or in the form of a lattice. The cartridge holders might be arranged otherwise. The cartridge holders need not to be formed of a single member, but may be formed of separate members.

In each of the embodiments, the ink cartridges are square or hexagonal in horizontal cross section, or cylindrical. However, the ink cartridges might be formed otherwise and take the form of polygons other than a square and a hexagon in horizontal section. Should the ink cartridges be neither polygonal in horizontal cross section nor cylindrical, they may be joined together by joints which are in rotation symmetry for engagement in different orientations.

In the embodiments, each of the ink containers has a projection, and each of the lids has an insertion part as an ink supply port. Alternatively, each of the ink containers may have an insertion part formed at bottom thereof, and each of the lids may have a projection.

In each of the embodiments, each of the ink cartridges has a projection, and each of the cartridge holders has a slit for engagement with one of the projections of the cartridges. Alternatively, each of the cartridge holders may have a projection, and each of the ink cartridges may have a slit (a groove) for engagement with one of the projections of the cartridges.

In each of the embodiments, the ink cartridges are prevented from being mounted in wrong cartridge holders of the ink jet printer. An apparatus other than ink jet printers may have cartridge holders each of which has a positioning part. The positioning part can engage with the engaging part of one of the ink cartridges according to the present invention. The positioning parts of the cartridge holders prevent the ink cartridges from being mounted in wrong cartridge holders. For example, an apparatus for filling empty ink cartridges with different inks has cartridge holders each of which has a positioning part. The positioning part can engage with the engaging part of one of the ink cartridges. The positioning parts of the cartridge holders prevent the ink cartridges from being mounted in wrong cartridge holders and filled with wrong inks.

In the embodiments, each of the ink cartridges includes an insertion part as an ink supply port formed at one end thereof (the lid) and has an air hole cut through the other end (the closed end of the ink container). The present invention may be applied to ink cartridges each of which has both an ink supply port and an air intake port formed at one end thereof (for example, ink cartridges from which ink is supplied through buffer tanks to an ink jet head). In this case, as is the case with the embodiments, the ink supply port is positioned off the center of the lid of the ink cartridge. The air intake port is arranged at the center of the lid. This enables the positions of the air intake ports to be common in ink cartridges where the lids are joined in different postures to the ink containers.

What is claimed is:

1. A set of plurality of ink cartridges mountable on mounting parts of an ink jet printer and which store different inks, wherein:

each of the ink cartridges comprises:

a cartridge body;

an ink supplying part provided in the cartridge body; and an engaging part for engaging with one of the mounting parts when an ink cartridge is mounted on the one of mounting parts, the engaging part being formed to have a rotational symmetry in each of the cartridges; and the cartridges have different patterns from each other in positional relationship between the ink supplying part and the engaging part, as seen from a direction in which the ink cartridges are mounted on the mounting parts.

2. An ink jet printer on which a plurality of ink cartridges are mounted, the ink cartridges each including a cartridge body and an ink supplying part provided in the cartridge body, the ink cartridges storing different inks, wherein:

the ink jet printer has a plurality of cartridge mounting parts on which the plurality of ink cartridges are mounted, respectively;

each of the cartridge mounting parts includes:

an ink introducing part which is connected to the supplying part of an associated ink cartridge of the ink cartridges and introduces ink thereto; and a positioning part which positions the associated ink cartridge in a predetermined position; and the cartridge mounting parts have different patterns from each other in positional relationship between the ink introducing part and the positioning part, as seen from a direction in which the ink cartridges are mounted on the mounting parts, and each of the cartridge mounting parts is formed to have a rotational symmetry.

3. The ink jet printer according to claim 2, wherein the positioning parts are respectively provided in a same position in the cartridge mounting parts.

4. The ink jet printer according to claim 2, wherein the ink introducing parts are respectively provided in a same position in the cartridge mounting parts.

5. The ink jet printer according to claim 2, wherein the cartridge mounting parts are arranged in a line.

6. The ink jet printer according to claim 5, wherein respective ink introducing parts of two adjacent cartridge mounting parts are provided close to each other.

7. The ink jet printer according to claim 2, wherein the cartridge mounting parts have four cartridge mounting parts arranged in a form of a lattice.

8. The ink jet printer according to claim 7, wherein respective ink introducing parts of the four cartridge mounting parts are concentrated inward as seen in the direction in which the ink cartridges are mounted on the cartridge mounting parts.

9. The ink jet printer according to claim 2, wherein each of the ink cartridges includes an engaging part for engaging with the positioning part of an associated cartridge mounting part.

10. The ink jet printer according to claim 2, further comprising the plurality of ink cartridges.

11. An ink jet printer on which a plurality of ink cartridges are mounted, the ink cartridges each including a cartridge body and an ink supplying part provided in the cartridge body, the ink cartridges storing different inks, wherein:

the ink jet printer has a plurality of cartridge mounting parts on which the plurality of ink cartridges are mounted, respectively;

each of the cartridge mounting parts includes:

an ink introducing part which is connected to the supplying part of an associated ink cartridge of the ink cartridges and introduces ink thereto; and a positioning part which positions the associated ink cartridge in a predetermined position; and the cartridge mounting parts have different patterns from each other in positional relationship between the ink introducing part and the positioning part, as seen from a direction in which the ink cartridges are mounted on the mounting parts, wherein:

the cartridge body of each of the ink cartridges has a first member for containing ink, and a second member;

the first member has an engaging part for engaging with the positioning part of an associated cartridge mounting part of the cartridge mounting parts; and a first joining part for joining the first member to the second member;

the second member has a second joining part which enables the second member to be joined to the first joining part in one of various orientations; and the ink supplying part provided off the center of the second joining part.

12. An ink cartridge which stores ink to be supplied to an ink jet printer, the cartridge comprising: a first member; and a second member which is joined to the first member, wherein: the first member has an engaging part for positioning the ink cartridge in a predetermined position in the ink jet printer, and a first joining part for joining the first member to the second member; the second member has a second joining part which enables the second member to be joined to the first joining part in one of various orientations, and an ink supplying part provided off a center of the second joining part wherein each of the first and second joining parts is formed with rotational symmetry.

13. The ink cartridge according to claim 12, wherein the second member is joined to the first member in one of plurality of postures which have different positions of the engaging part relative to the ink supplying part.

14. The ink cartridge according to claim 12, wherein the first member is an ink container, and wherein the second member is a lid for closing an opening of the ink container.

15. The ink cartridge according to claim 14, wherein the lid and the opening of the ink container respectively has a shape of a circle or a regular polygon.

16. The ink cartridge according to claim 15, wherein the lid and the opening of the ink container respectively has a shape of a regular polygon, and wherein a number of the plurality of postures in which the lid is joined to the ink container equals a number of sides of the polygon.

17. A set of ink cartridges each as defined in claim 12, wherein the ink cartridges are assembled with the first and second joining parts joined in different orientations.

18. A method for producing a set of ink cartridges as defined in claim 17, the method comprising the steps of:

assembling a first ink cartridge by joining the first joining part of the first member of the first ink cartridge and the second joining part of the second member of the first ink cartridge together in a predetermined orientation; and assembling a second ink cartridge by joining the first joining part of the first member of the second ink cartridge and the second joining part of the second member of the second ink cartridge together in another orientation different from the predetermined orientation.

19. The method according to claim 18, wherein the first and second joining parts are in rotational symmetry.

* * * * *